US007374427B2

(12) United States Patent
Kodaira et al.

(10) Patent No.: US 7,374,427 B2
(45) Date of Patent: May 20, 2008

(54) COAXIAL CABLE DISTRIBUTOR

(75) Inventors: Makoto Kodaira, Tokyo (JP); Jun Kimura, Tokyo (JP); Yuji Ichikawa, Tokyo (JP)

(73) Assignee: Uro Denshi Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/545,558

(22) PCT Filed: Jul. 14, 2003

(86) PCT No.: PCT/JP03/08926

§ 371 (c)(1),
(2), (4) Date: Apr. 6, 2006

(87) PCT Pub. No.: WO2004/073119

PCT Pub. Date: Aug. 26, 2004

(65) Prior Publication Data

US 2006/0211303 A1 Sep. 21, 2006

(30) Foreign Application Priority Data

Feb. 17, 2003 (JP) ..... 2003-037531

(51) Int. Cl.
*H01R 12/00* (2006.01)

(52) U.S. Cl. ..... 439/63; 439/578; 439/20

(58) Field of Classification Search ..... 439/63, 439/578, 11–14, 20, 31
See application file for complete search history.

(56) References Cited

U.S. PATENT DOCUMENTS

2006/0211303 A1* 9/2006 Kodaira et al. ..... 439/579

FOREIGN PATENT DOCUMENTS

| | | |
|---|---|---|
| JP | 10-189163 | 7/1998 |
| JP | 11-097121 | 4/1999 |
| JP | 2002-170638 | 6/2002 |
| JP | 2003-078780 | 3/2003 |

* cited by examiner

*Primary Examiner*—Khiem Nguyen
(74) *Attorney, Agent, or Firm*—Mattingly, Stanger, Malur & Brundidge, P.C.

(57) ABSTRACT

A coaxial cable distributor, wherein three or more junction plugs (2) are fitted to the surface of a casing (1) having a hollow therein, the external contacts of the junction plugs (2) are electrically connected to each other through the casing (1), the center contacts of the junction plugs (2) are electrically connected to each other in the hollow of the casing (1), and at least two of the junction plugs (2) are rotated about the rotating axis in a direction orthogonal to the projected direction thereof from the surface of the casing (1) while maintaining the electrical connection between the external contacts and between the center contacts.

2 Claims, 38 Drawing Sheets

(a)

(b)

(c)

(a)

(b)

(c)

(a)

(b)

(a)

(b)

(a)

(b)

(c)

(a)

(b)

(a)

(b)

(a)

(b)

(a)

(b)

(a)

(b)

(c)

(a)

(b)

(a)

(b)

(a)

(b)

(a)

(b)

(a)

(b)

(a)

(b)

(a)

(b)

(c)

(a)

(b)

(c)

(a)

(b)

(a)

(b)

(a)

(b)

(a)

(b)

(c)

(a)

(b)

(c)

(a)

(b)

(a)

(b)

COAXIAL CABLE DISTRIBUTOR

TECHNICAL FIELD

The present invention relates to a technology effective to be applied to a coaxial cable distributor or a turnout for distributing signals transmitting a piece of coaxial cable into plural coaxial cables.

BACKGROUND ART

Heretofore, when a coaxial terminal such as a TV terminal provided on a wall surface and the like and plural TV receivers are connected by a coaxial cable, a distributor or an appliance called as a turnout is used.

In general, the distributor is fitted with three or more coaxial cable connecting terminals (hereinafter referred to as junction plug) comprising center contacts and cylindrical external contacts concentrically provided with the center contacts on a casing having a hollow therein. At this time, the casing is made of metal, and the external contacts of each junction plug are electrically connected to each other by the casing. Further, the center contacts are electrically connected to each other by printed circuit board and the like provided inside the hollow of the casing.

When the distributor is used, for example, one of the junction plugs and the TV terminal provided on the wall surface are connected by the coaxial cable, and the other junction plug provided in the distributor and the input terminal of the TV receiver are connected by the other coaxial cable. At this time, if the junction plugs provided in the distributor are three, since one junction plug is connected to the TV terminal on the wall surface, the remaining two junction plugs can be connected to two TV receivers.

Further, the turnout is also the same as the distributor, and is provided with several turnout point (output) junction plugs in addition to a pair of input junction plugs and output junction plugs.

The number of TV terminals provided on the wall surface and the like of the house is usually from one to several pieces for each room. Hence, when each TV terminal is connected to the terminal of each TV receiver, TV pictures can be watched only by the same number of TV receivers provided on the wall surface. On the contrary, in case a large number of TV receivers are installed in a room, the number of TV terminals on the wall surface must be increased according to the number of TV receivers installed.

Further, when the position of the TV terminal on the wall surface and the installation position of the TV receiver are kept away from each other, the laying of the coaxial cable tends to be complicated.

Hence, by using the coaxial distributor or the turnout, a large number of TV receivers can be installed. Further, by using the distributor or the turnout, the input terminals of plural TV receivers can be connected to the TV terminals in the vicinity, and the laying of the coaxial cable can be simplified.

Further, in addition to the case where an appliance such as the distributor or the turnout is used indoor as when the TV terminals and plural TV receivers are connected, the appliance is also used, for example, when the coaxial cable installed outdoor is led into plural rooms inside a building. At this time, the distributor or the turnout is, for example, fitted to the inside of a ceiling or the rear surface of the wall or the like, and one of the junction plugs is connected to the coaxial cable led from outdoor, and the coaxial cable connected to the remaining junction plugs is led to the walls of each room so as to be connected to the TV terminal fitted to each wall surface.

However, the junction plug of such a distributor fixes the external contact and the casing by screws and the like. That is, since the conventional distributor or the turnout is fixed in a leading direction of the connected coaxial cable, the distributor or the turnout matching with the leading direction of the coaxial cable must be selected. Hence, there has been a problem in that the conventional distributor or the turnout lacks a degree of freedom of the installation place, that is, versatility.

Further, when the coaxial cable is connected to the distributor or the turnout, it is usually after the distributor or the turnout are fitted to the wall surface, the floor surface, the ceiling, and the like that the coaxial cable is connected to the distributor or the turnout. At this time, when the junction plug provided in the distributor is protruded in parallel with the wall surface, there has been a problem in that operability is poor at the time of connecting the coaxial cable to the junction plug. Further, in case plural junction plugs come into line, when the interval between the junction plugs is narrow, there has been a problem in that operability is poor at the time of connecting the coaxial cable to the junction plug in the vicinity of the center.

Further, since the conventional distributor or turnout has the junction plug fixed to the casing, the leading direction of the connected coaxial cable is constant, and it is often the case that extreme bending is required for the laying of the cable. When the coaxial cable is extremely bent, however, there has been a problem in that noises tend to be generated due to change of characteristic impedance or central conductor and outer conductor become easily disconnected.

Consequently, an object of the present invention is to provide a technology capable of enhancing versatility of the coaxial cable distributor or the turnout.

Further, an object of the present invention is to provide a technology, which can enhance operability at the time of connecting the coaxial cable to the junction plug of the coaxial cable or the turnout.

Further, an object of the present invention is to provide a technology capable of preventing noises and the breaking of the coaxial cable due to extreme bending of the coaxial cable connected to the distributor or the turnout.

DISCLOSURE OF THE INVENTION

The present invention is configured by being fitted with three or more coaxial cable connecting terminals (hereinafter referred to junction plug) comprising center contacts and cylindrical external contacts concentrically provided with the center contacts on the surface of a casing having a hollow therein, wherein the external contacts of each junction plug are electrically connected to each other by the casing, and the center contacts are coaxial cable distributors electrically connected to each other inside the hollow of the casing, and from among the junction plugs, at least two junction plugs are the coaxial cable distributors rotating with a direction orthogonal to the projecting direction from the surface of the casing as an axis of rotation, while maintaining the electrical connection with the external contacts and the center contacts.

Further, the present invention is a coaxial cable distributor, wherein the external contact of the rotating junction plug is configured by a joint for connecting the outer conductor of the coaxial cable or the outer conductor of the plug provided on the top end of the coaxial cable, and a hinged end in which an opening to lead out a projection having a circular bottom and the center contact outside of the external contact is provided, and wherein the casing is provided with a support for supporting the projection provided in the hinged end of the external contact.

According to these coaxial cable distributors, if the junction plug is within a rotational range, it is possible to freely set the leading direction of the connected coaxial cable. At this time, for example, if the rotational ranges of two junction plugs provided in one surface of the casing are 180 degree, the coaxial cable connected to each junction plug can be led to the same direction, a vertical direction, an opposite direction, and the like. Hence, comparing with the conventional distributor, a degree of freedom (versatility) of the installation place and the like can be enhanced.

Further, since the junction plug is rotated, after the coaxial cable distributor is fitted to the wall surface and the like, the coaxial cable can be connected, for example, in a state in which the junction plug is directed vertically to the wall surface and the like. Hence, operability is enhanced at the time of connecting the coaxial cable. Further, since the junction plug is rotated, for example, even when plural junction plugs are lined up, desired junction plugs alone are directed in a separate direction, so that the coaxial cable can be connected. Hence, even in case the interval between the junction cables is narrow, operability is good at the time of connecting the coaxial cable.

Further, since the junction plug is rotated and the leading direction of the coaxial cable can be changed, a degree of bending of the coaxial cable connected to the junction plug can be reduced. Hence, generation of noises and disconnection of the cable due to bending of the coaxial cable can be prevented.

At this time also, a shape of the casing of the coaxial cable, the total number of junction plugs and the number of rotating junction plugs, and a direction of the axis of rotation and rotational angle range of the rotating junction plug can be selected variously.

BEST MODE FOR CARRYING OUT THE INVENTION

Figure 1:
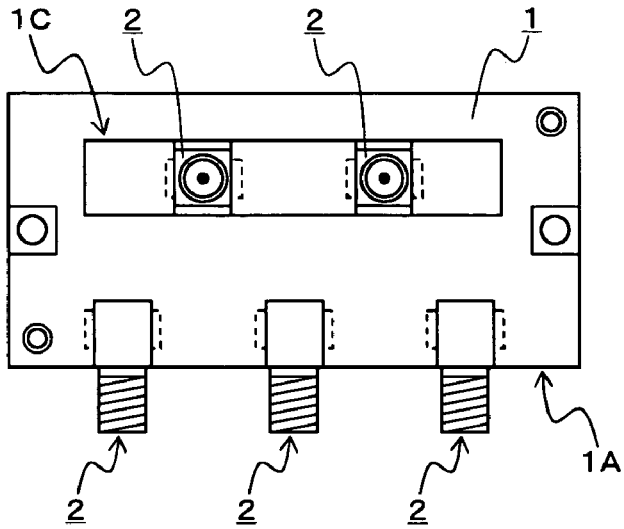
FIG. 1 is a schematic illustration showing a schematic structure of a coaxial cable distributor of a first embodiment according to the present invention, and FIG. 1(*a*) is a top view of a distributor, and FIG. 1(*b*) is a front view of FIG. 1(*a*), and FIG. 1(*c*) is a left side view of FIG. 1(*b*)
Figure 1:
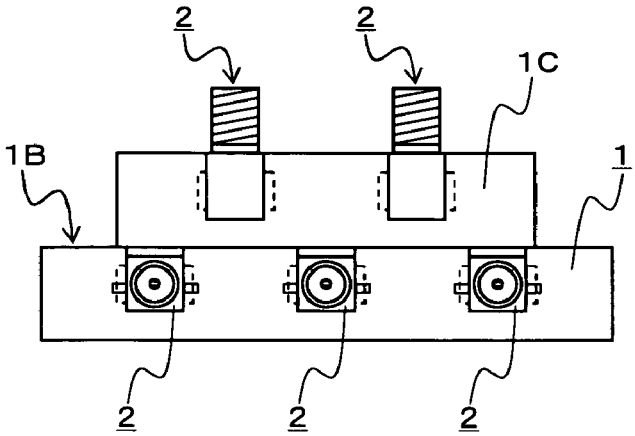
Figure 1:
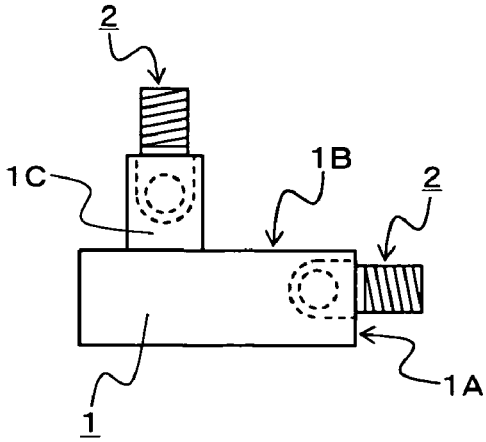

To explain the present invention more in detail, a description will be made on the invention in accordance with the accompanying drawings.

In all the drawings for explaining the embodiments, the same reference numerals will be attached to the components having the same functions, and repeated descriptions thereof will be omitted.

The present invention is configured to be fitted with three or more coaxial cable connecting terminals (hereinafter referred to junction plug) comprising center contacts and cylindrical external contacts concentrically provided with the center contacts on the surface of a casing having a hollow therein, wherein the external contacts of each junction plug are electrically connected to each other by the casing, and the center contacts are coaxial cable distributors electrically connected to each other inside the hollow of the casing, and from among the junction plugs, at least two junction plugs are the coaxial cable distributors , which rotate with a direction orthogonal to the projecting direction from the surface of the casing as an axis of rotation, while maintaining the electrical connection with the external contacts and the center contacts.

First Embodiment

Figure 2:
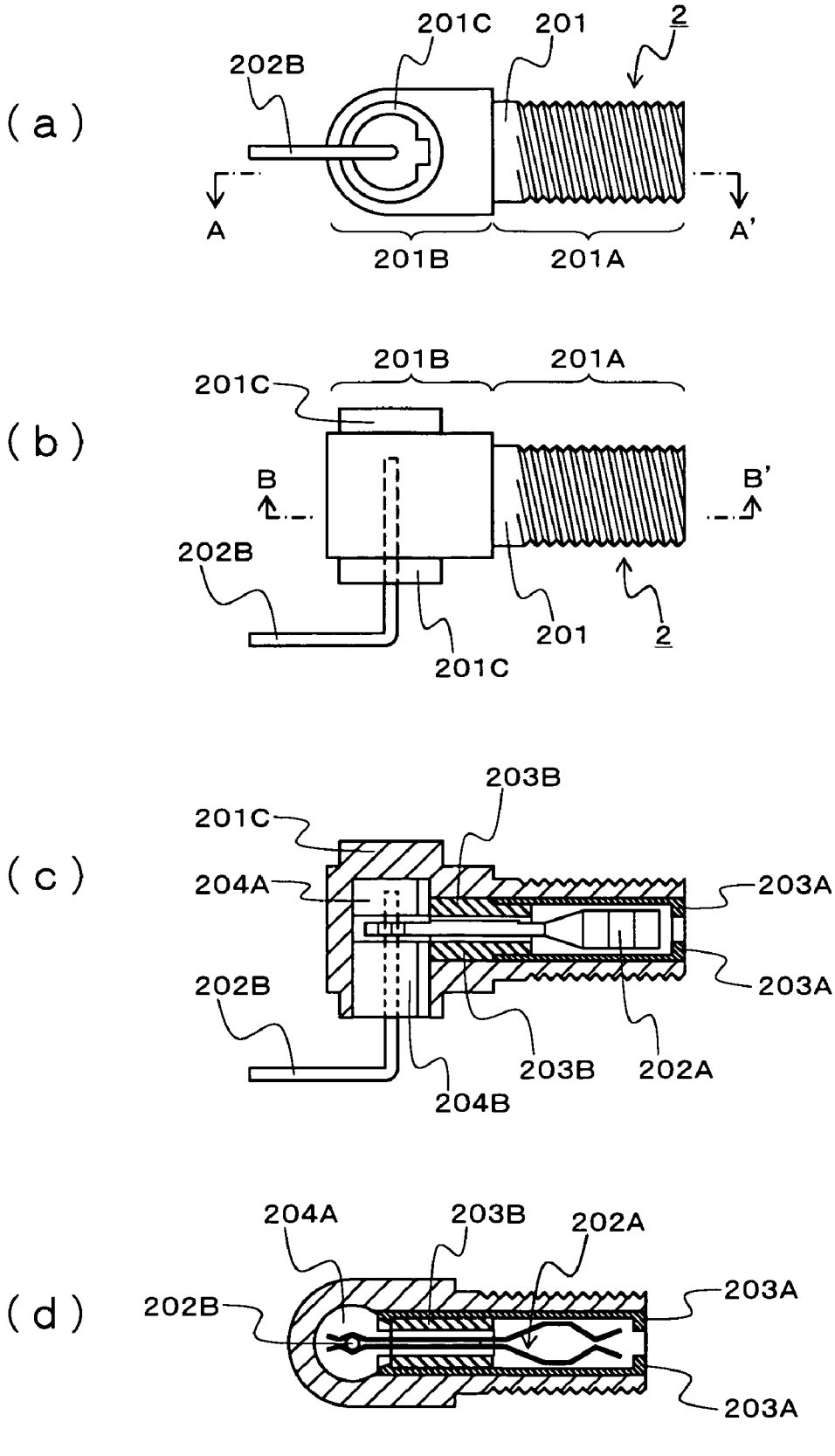
FIG. 2 is a schematic illustration showing a schematic structure of the coaxial cable distributor of the present first embodiment, and FIG. 2(*a*) is a front view showing a schematic structure of a junction plug, and FIG. 2(*b*) is a top view of FIG. 2(*a*), and FIG. 2(*c*) is a view showing the internal structure of a junction plug and is a view seen from the line A to A' of FIG. 2(*a*), and FIG. 2(*d*) is a schematic illustration showing the internal structure of a junction plug and is a view seen from the line B to B' of FIG. 2(*b*)
Figure 3:
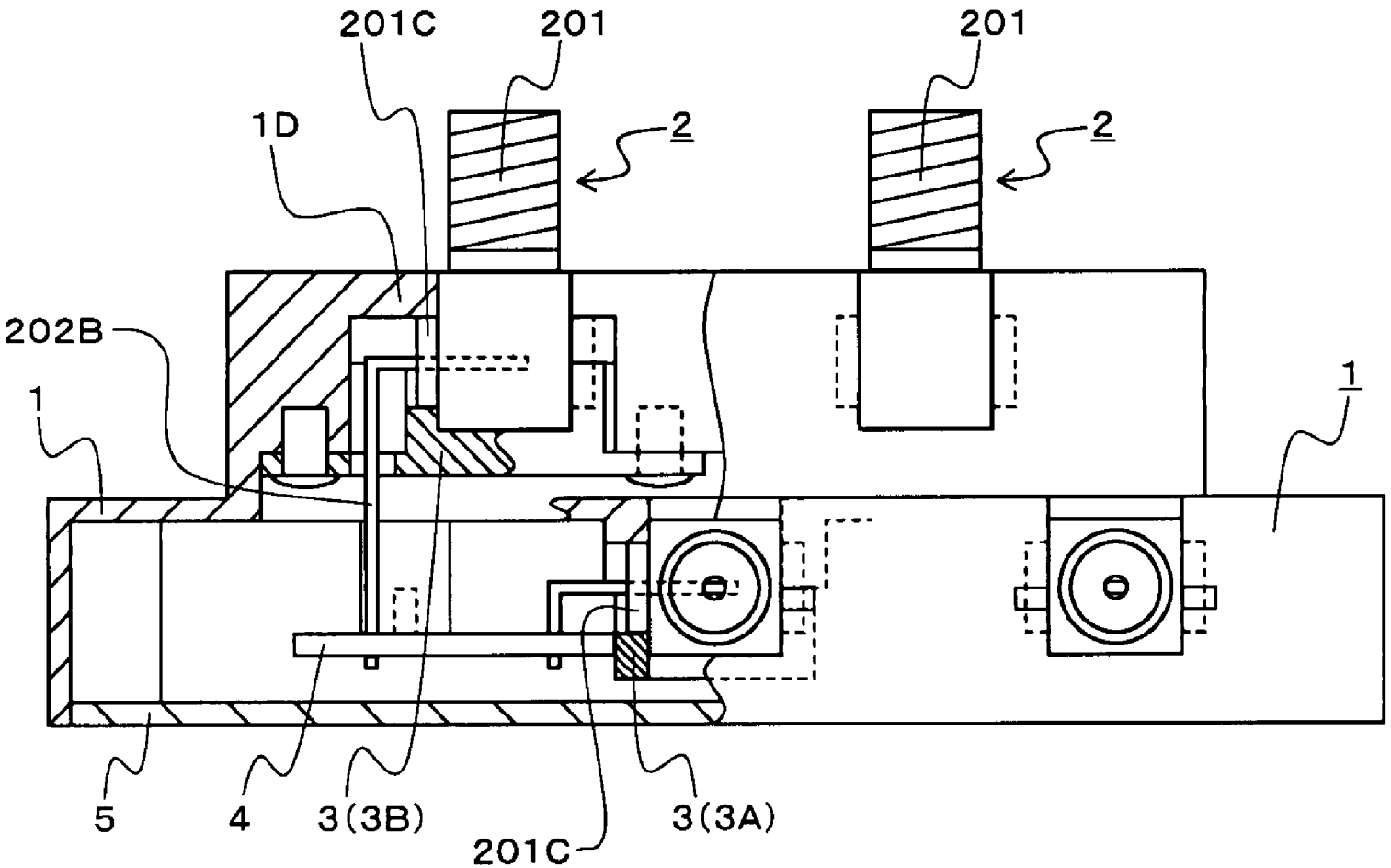
FIG. 3 is a schematic illustration showing a schematic structure of the coaxial cable distributor of the present first embodiment, and is a front view of the internal structure of the distributor.
Figure 4:
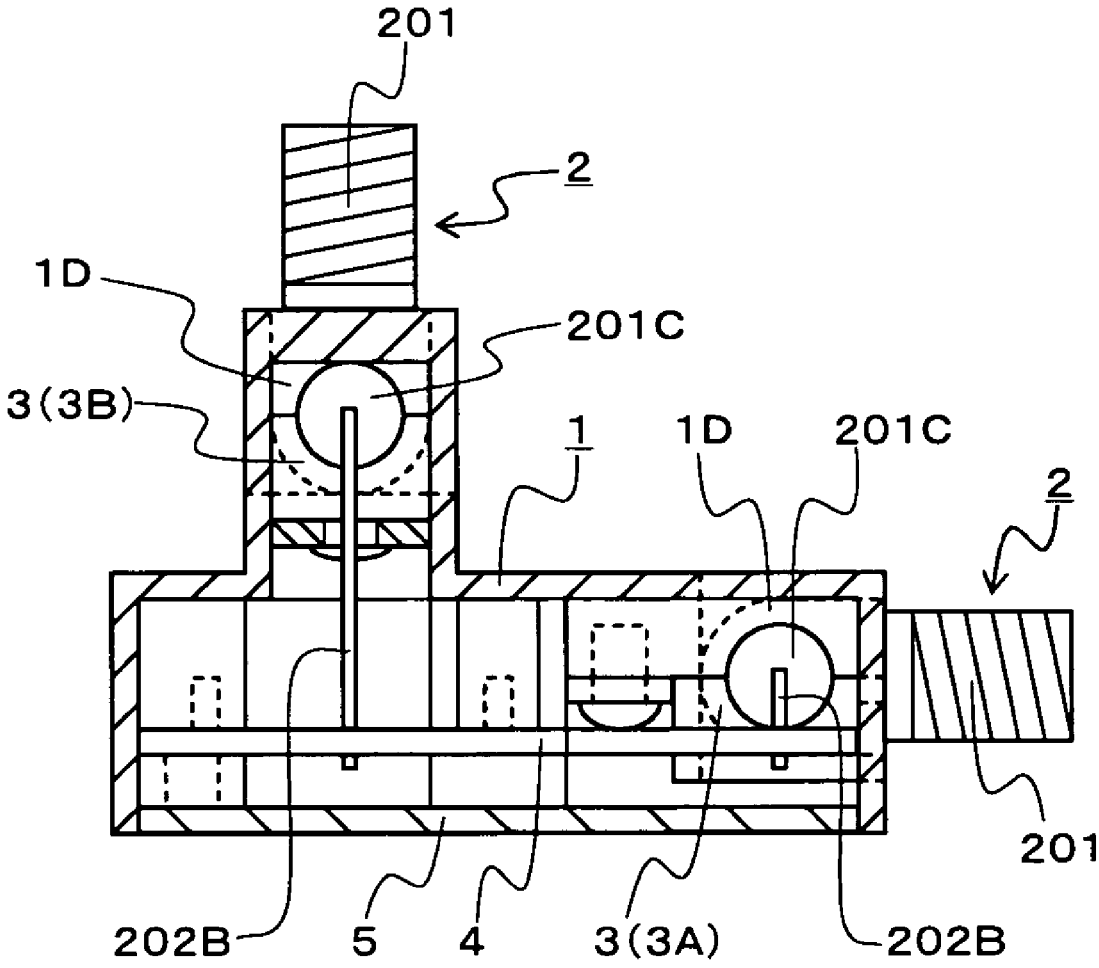
FIG. 4 is a schematic illustration showing a schematic structure of the coaxial cable distributor of the present first embodiment, and is the left side view of the internal structure of the distributor.
Figure 5:
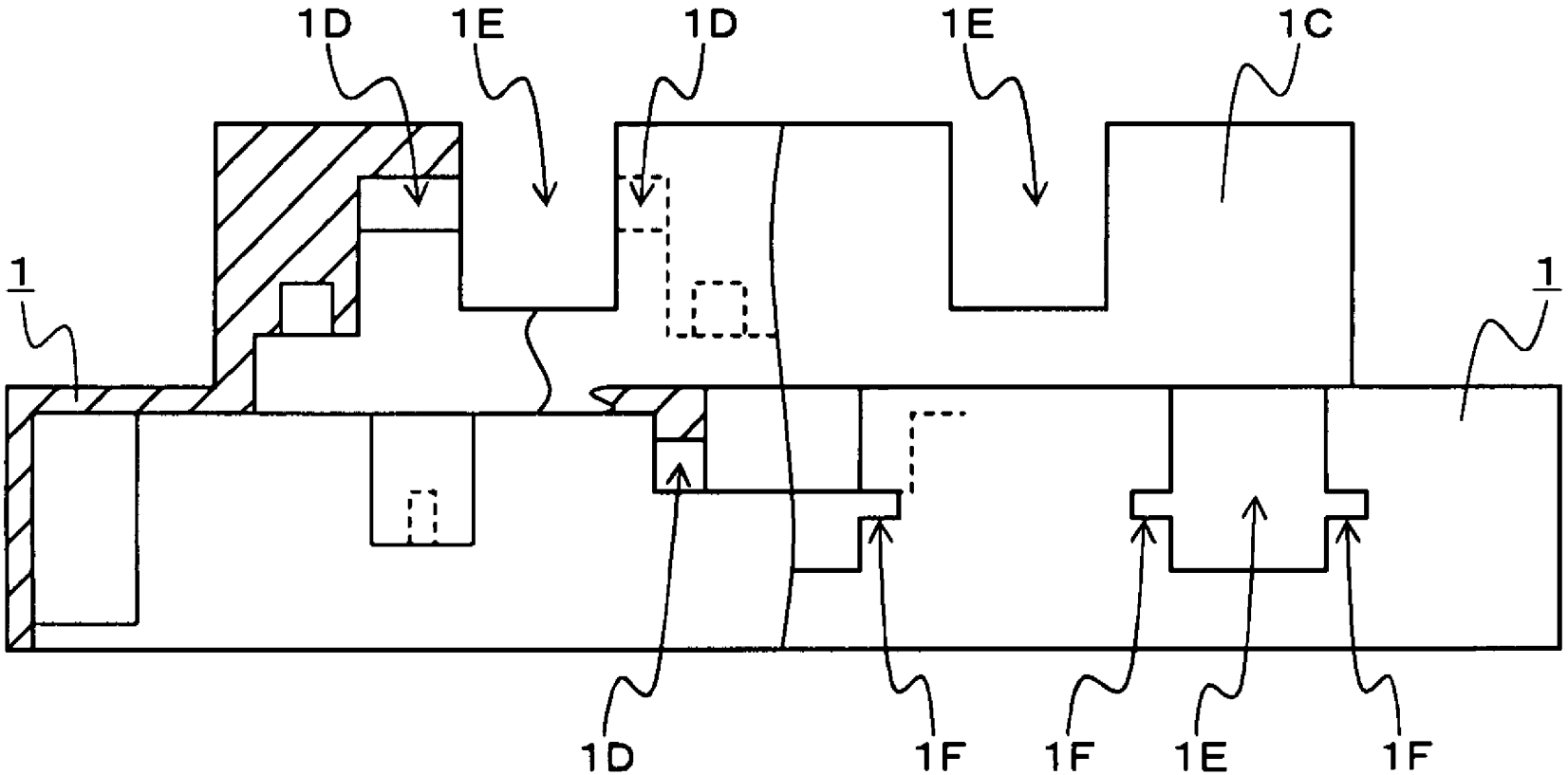
FIG. 5 is a schematic illustration showing a schematic structure of the coaxial cable distributor of the present first embodiment, and is the front view showing a structure of a casing.
Figure 6:
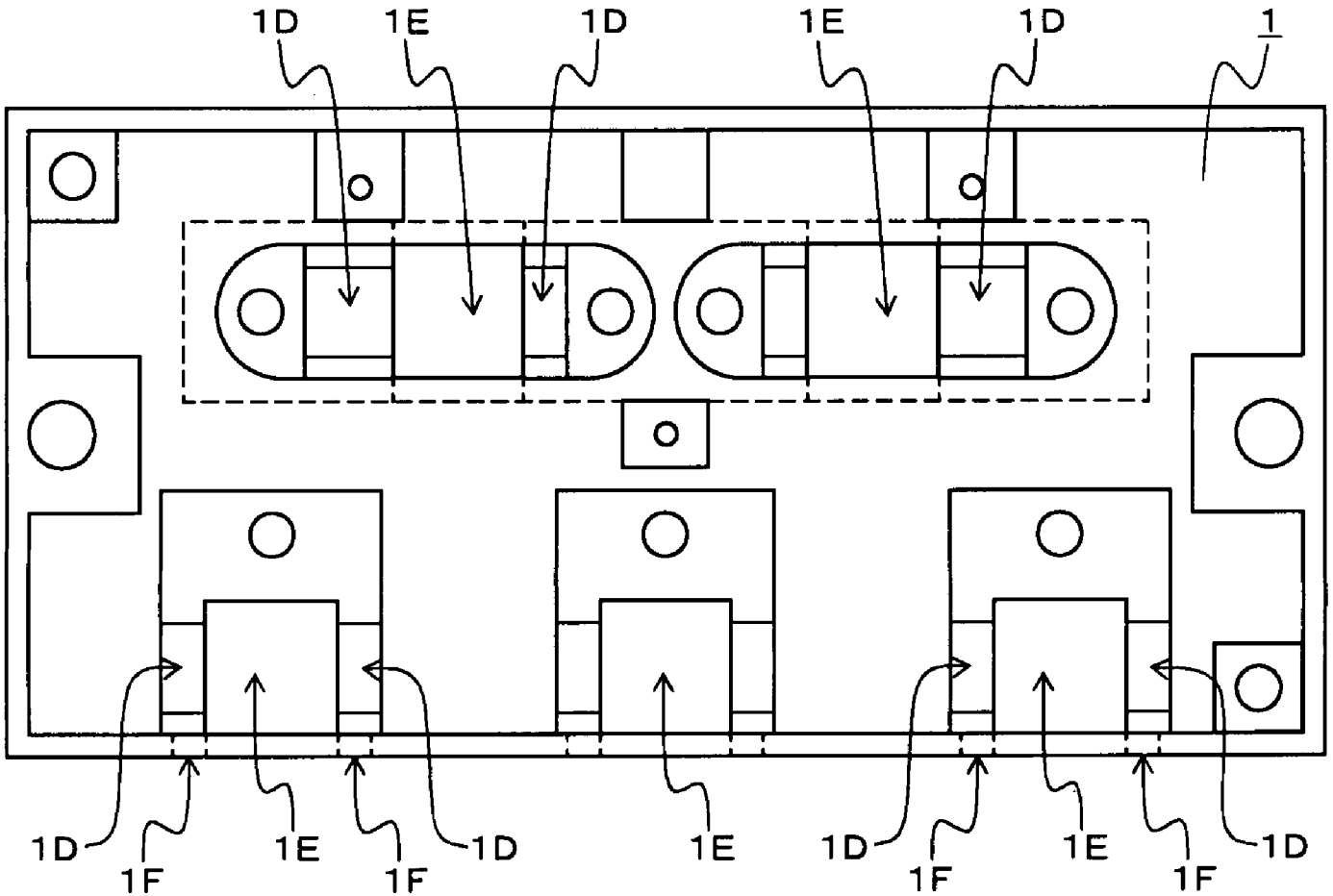
FIG. 6 is a schematic illustration showing a schematic structure of the coaxial cable distributor of the present first embodiment, and is a bottom view of FIG. 5.
Figure 7:
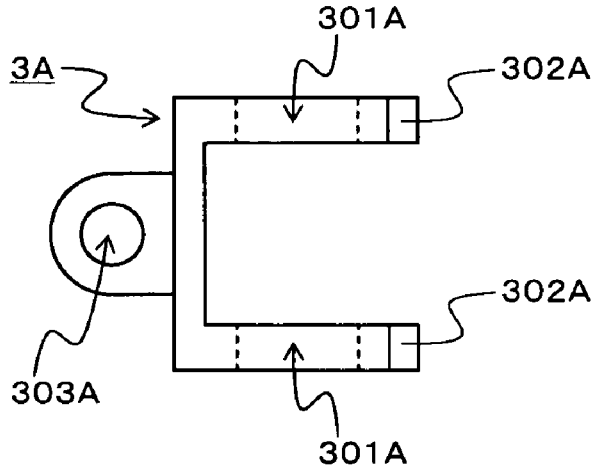
FIG. 7 is a schematic illustration showing a schematic structure of the coaxial cable distributor of the present first embodiment, and FIG. 7(*a*) is a top view showing a structure of a first junction plug fixing bracket, and FIG. 7(*b*) is a front view of FIG. 7(*a*), and FIG. 7(*c*) is a right side view of FIG. 7(*b*)
Figure 7:
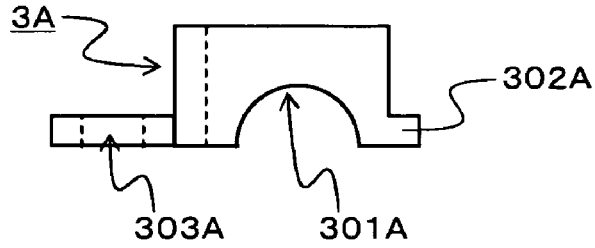
Figure 7:
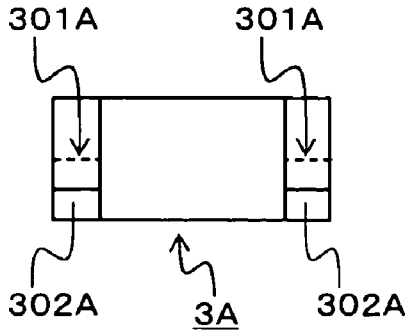
Figure 8:
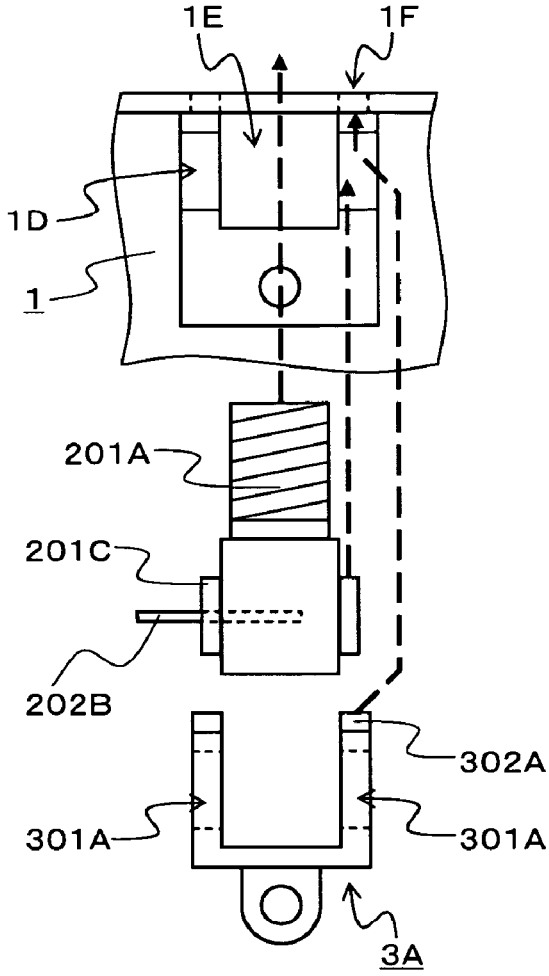
FIG. 8 is a schematic illustration showing a schematic structure of the coaxial cable distributor of the present first embodiment, and FIGS. 8(*a*) and 8(*b*) are views for explaining a fitting method of the junction plug using the first junction plug fixing bracket.
Figure 8:
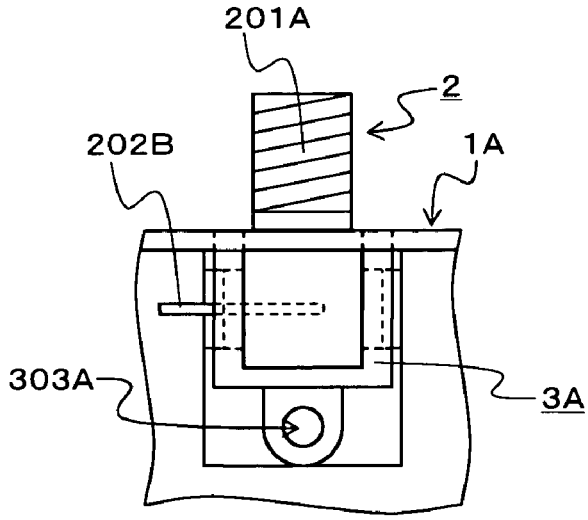
Figure 9:
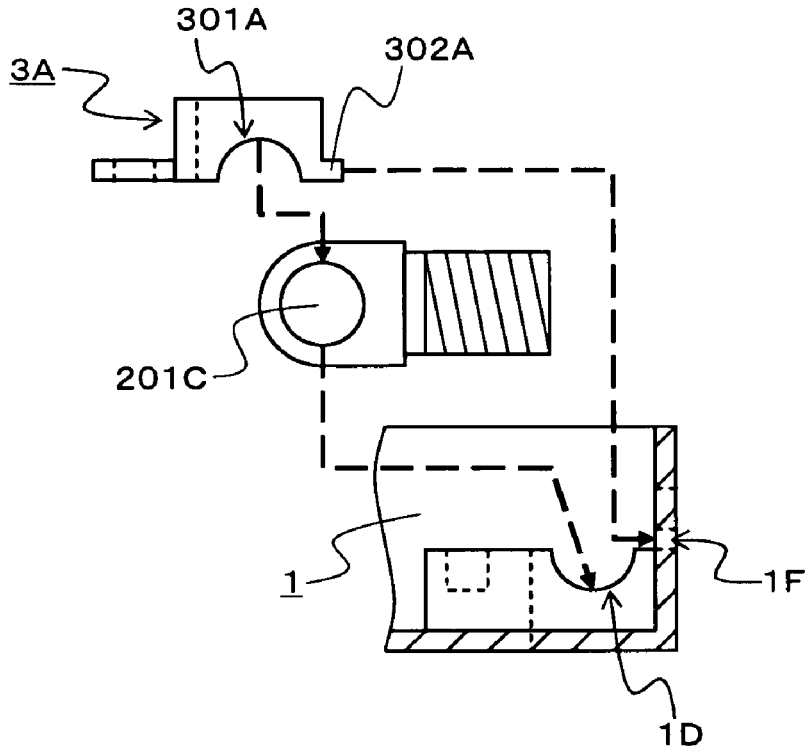
FIG. 9 is a schematic illustration showing a schematic structure of the coaxial cable distributor of the present first embodiment, and FIGS. 9(*a*) and 9(*b*) are views for explaining a fitting method of the junction plug using the first junction plug fixing bracket.
Figure 9:
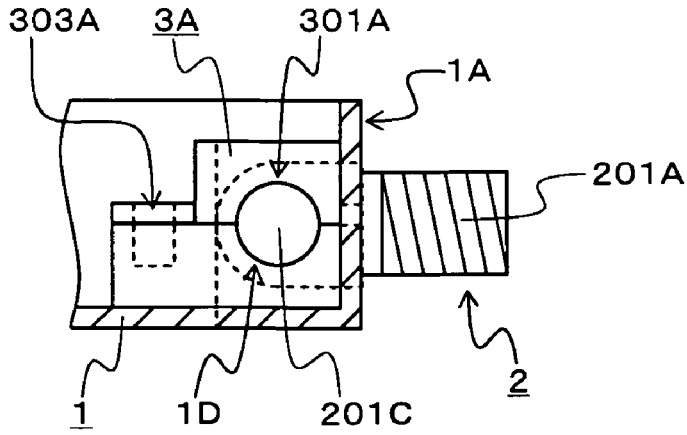
Figure 10:
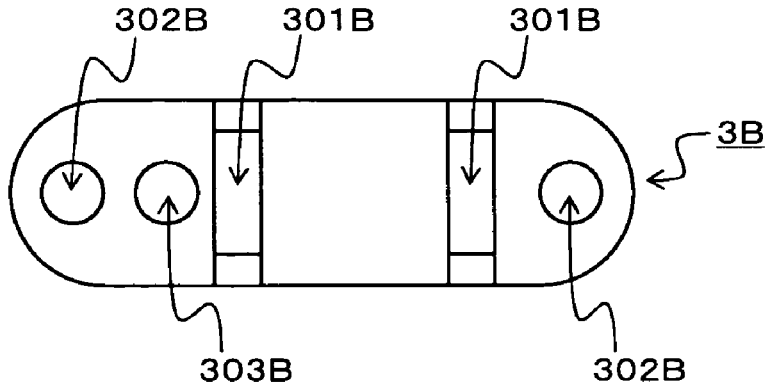
FIG. 10 is a schematic illustration showing a schematic structure of the coaxial cable distributor of the present first embodiment, and FIG. 10(*a*) is a top view showing a structure of a second junction plug fixing bracket, and FIG. 10(*b*) is a front view of FIG. 10(*a*), and FIG. 10(*c*) is a right side view of FIG. 10(*b*)
Figure 10:
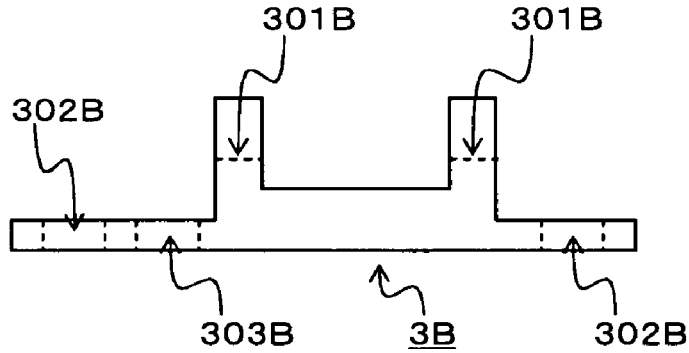
Figure 10:
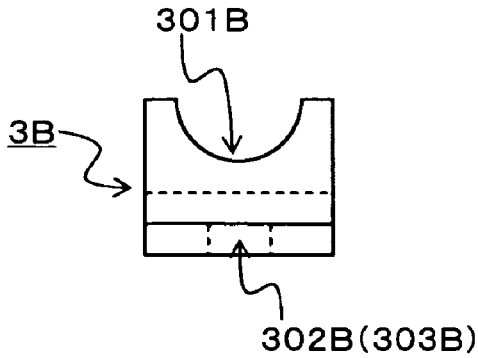
Figure 11:
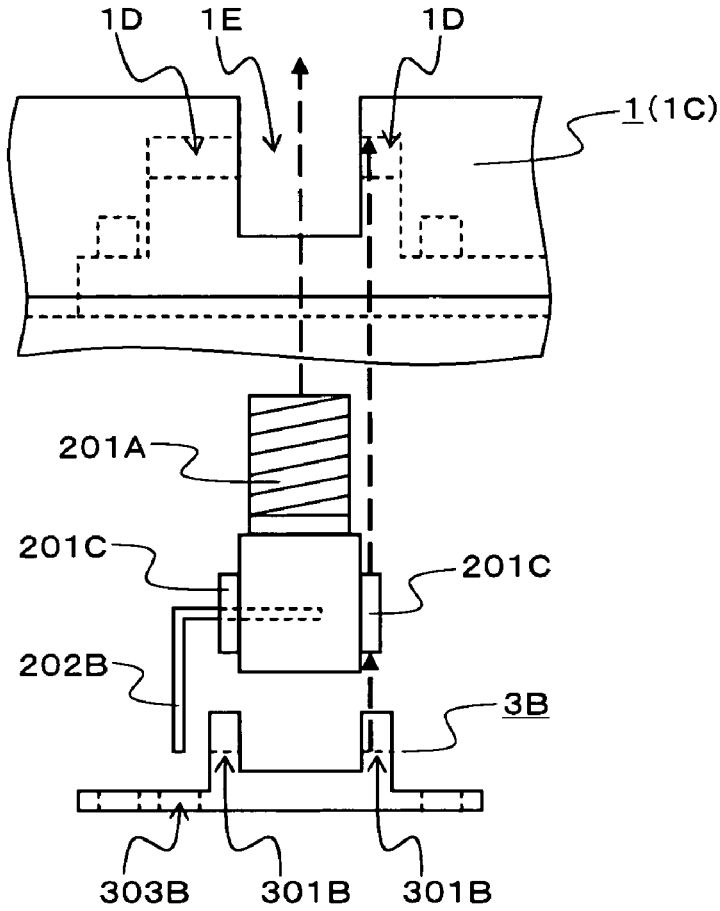
FIG. 11 is a schematic illustration showing a schematic structure of the coaxial cable distributor of the present first embodiment, and FIGS. 11(*a*) and 11(*b*) are views for explaining a fitting method of the junction plug using the second junction plug fixing bracket.
Figure 11:
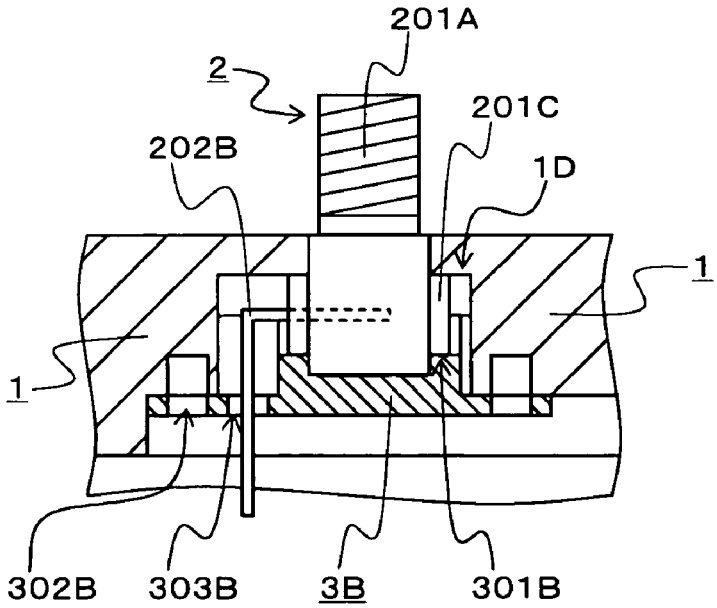
Figure 12:
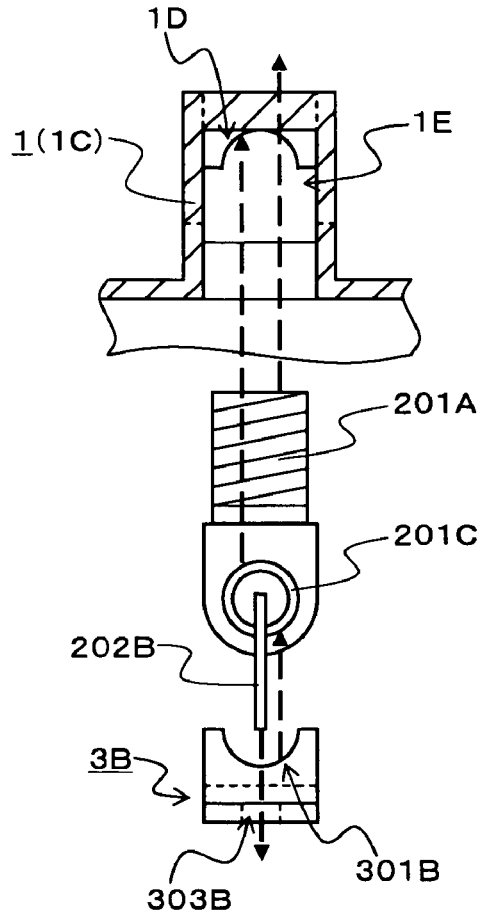
FIG. 12 is a schematic illustration showing a schematic structure of the coaxial cable distributor of the present first embodiment, and FIGS. 12(*a*) and 12(*b*) are views for explaining a fitting method of the junction plug using the second junction plug fixing bracket.
Figure 12:
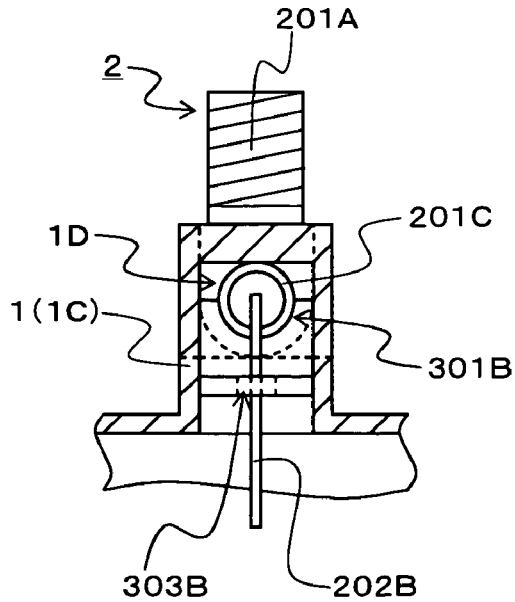

FIGS. 1 to 12 are schematic illustrations showing a schematic structure of the coaxial cable of a first embodiment according to the present invention, and FIG. 1(*a*) is a top plan view of the distributor, and FIG. 1(*b*) is a front view of FIG. 1(*a*), and FIG. 1(*c*) is a left side view of FIG. 1(*b*), and FIG. 2(*a*) is a front view showing a schematic structure of a junction plug, and FIG. 2(*b*) is a top view of FIG. 2(*a*), and FIG. 2(*c*) is a view showing the internal structure of the junction plug and is a view seen from the line A to A' of FIG. 2(*b*), and FIG. 2(*d*) is a schematic illustration showing the internal structure of the junction plug and is a view seen from the line B to B' of FIG. 2(*b*), FIG. 3 is a front view showing the internal structure of the distributor, and FIG. 4 is a left side view showing the internal structure of the distributor, and FIG. 5 is a front view showing the structure of a casing, and FIG. 6 is a bottom view of FIG. 5, and FIG. 7(*a*) is a top view showing the structure of a first junction plug fixing bracket, and FIG. 7(*b*) is a front view of FIG. 7(*a*), and FIG. 7(*c*) is a right side view of FIG. 7(*b*), and FIGS. 8(*a*) and 8(*b*), and FIGS. 9(*a*) and 9(*b*) are views for explaining a fitting method of the junction plug using the first junction plug fixing bracket, and FIG. 10(*a*) is a top view showing the structure of a second junction plug fixing bracket, and FIG. 10(*b*) is a front view of FIG. 10(*a*), and FIG. 10(*c*) is a right side view of FIG. 10(*b*), and FIGS. 11(*a*) and 11(*b*), and FIGS. 12(*a*) and 12(*b*) are views for explaining a fitting method of the second junction plug fixing bracket.

The coaxial cable distributor of the present first embodiment, as shown in FIGS. 1(*a*), 1(*b*), and 1(*c*), is fitted with five connecting terminals 2 (hereinafter referred to as junction plug) comprising center contacts and cylindrical external contacts concentrically provided with the center contacts on the surface of a metal made casing 1. At this time, the casing 1 is provided with a step 1C in a staircase pattern on a second surface 1B contacting a first surface 1A fitted with three junction plugs 2, and the remaining two junction plug 2 are fitted to the step 1C.

Further, an external contact 201 of the junction plug 2, as shown in FIGS. 2(*a*), 2(*b*), 2(*c*), and 2(*d*), is configured by an outer conductor of the coaxial cable or a joint 201A for connecting an outer conductor of the plug fitted to the coaxial cable and a hinged end 201B which becomes a support point of the rotation of the junction plug 2. At this time, the hinged end 201B is provided with a projection 201C with a circular bottom. Further, the hinged end 201B is provided with an opening for leading a center contact 202A provided inside the joint 201A outside of the external contact 201. In the present first embodiment, the junction plug 2 is a female type, and the center contact 202A, as shown in FIGS. 2(*c*) and 2(*d*), is configured by a spring conductor, and a contact pin 202B is inserted from the opening provided in the hinged end 201B, and is connected to the center contact 202A. Further, at this time, the center contact 202A is supported in the center axis vicinity of the joint 201A by a first bush 203A and a second bush 203B. Further, the portion connected with the center contact 202A of the contact pin 202B is supported on the axis passing through the center of the bottom face of each projection 201C by a first spacer 204A and a second spacer 204B.

Further, the casing 1 has a hollow therein, and the five junction plugs 2, as shown in FIGS. 3 and 4, have the external contacts 201 electrically connected to each other by the casing 1. At this time, the external contact 201 and the casing 1 are connected so as to support the projection 201C provided in the hinged end 201B of the external contact 201. Further, at this time, the joint between the casing 1 and the projection 201C is fixed by a junction plug fixing bracket 3.

Further, the center contacts 202A are connected to each other by connecting the contact pins 202B provided in each junction plug 2 to a printed circuit board 4 provided in the hollow of the casing 1. At this time, the casing 1 is opened in the surface of one direction, and into this opened surface, the printed circuit board 4 is inserted, and the conductor patterns of the contact pin 202B and the printed circuited board 4 are soldered, and after that, the opened surface is fitted with a back cover 5.

Further, at this time, the casing 1, as shown in FIGS. 5 and 6, is provided with a bearing 1D for supporting the projection 201C provided in the external contact 201. Further, within the casing 1, the portion to be fitted with the junction plug 2 is provided with a window 1E opened in two or three directions.

The projection 201C of the external contact 201 is borne by the bearing 1D, and as shown in FIGS. 3 and 4, the junction plug fixing bracket 3 is fitted to the casing 1, so that the external contact 2 can be rotated with the projection 201C of the hinged end as an axis of rotation.

Within the junction plug fixing bracket 3, a bracket (hereinafter referred to as a first junction plug fixing bracket) 3A, which fixes a junction plug 2 fitted to the first surface 1A of the casing 1, as shown in FIGS. 7(*a*), 7(*b*), and 7(*c*), is provided with a bearing 301A which bears the projection 201C of the external contact on two sides in parallel to a U shaped bracket. Further, the top end of a side provided with the bearing 301A is provided with a projection 302A. The projection 302A, for example, as shown in FIG. 5, is a projection to be fitted into a groove 1F. Further, a portion connecting each side in which the bearing 301A is provided is provided with a screw cramp 303A to be connected to the casing 1.

When the junction plug 2 is fitted to the casing 1 by using the first junction plug fixing bracket 3A, as shown in FIGS. 8(*a*) and 8(*b*), and FIGS. 9(*a*) and 9(*b*), the joint 201A of the junction plug 2 is inserted into the window 1E of the casing 1, and the projection 201C of the hinged end is borne by a bearing 1D of the casing 1. After that, the projection 302A of the first junction plug fixing bracket 3A is fitted into the groove 1F of the casing 1, and the projection 201C of the hinged end is borne by the bearing 301A, and the screw cramp 303A is screwed, so that the projection 201C of the external contact 201 is supported and fixed, and at the same time, the junction plug 2 can be rotated with the projection 201C as an axis of rotation.

Further, a junction plug fixing bracket (hereinafter referred to as a second junction plug fixing bracket) 3B, which supports and fixes the junction plug 2 fitted to the step 1C of the casing 1, as shown in FIGS. 10(*a*), 10(*b*), and 10(*c*), is provided with the bearing 301B which bears the projection 201C of the external contact on one surface of the metal plate. Further, the outside of the bearing 301A of the plate is provided with, for example, a screw hole 302B for fixing the second junction plug fixing bracket 3B to the casing 1 and a hole 303B for allowing the contact pin 202B led from the junction plug 2 to pass through.

When the junction plug 2 is fitted to the casing 1 by using the second junction plug fixing bracket 3B, as shown in FIGS. 11(*a*), 11(*b*), and 12(*a*) and 12(*b*), the joint 201A of the junction plug 2 is inserted into the window 1E of the casing 1, and the projection 201C of the hinged end is borne by the bearing 1D of the casing 1. After that, the second junction plug fixing bracket 3B is fitted into the casing 1 so that the contact pin 202B of the junction plug 2 passes through the hole 303B, and the projection 201C of the hinged end of the junction plug 2 is borne by the bearing 301B, and the screw cramp 302B is screwed, whereby the projection 201C of the external contact 201 is supported and fixed. At the same time, with the projection 201C as an axis of rotation, the junction plug 2 can be rotated.

Figure 13:
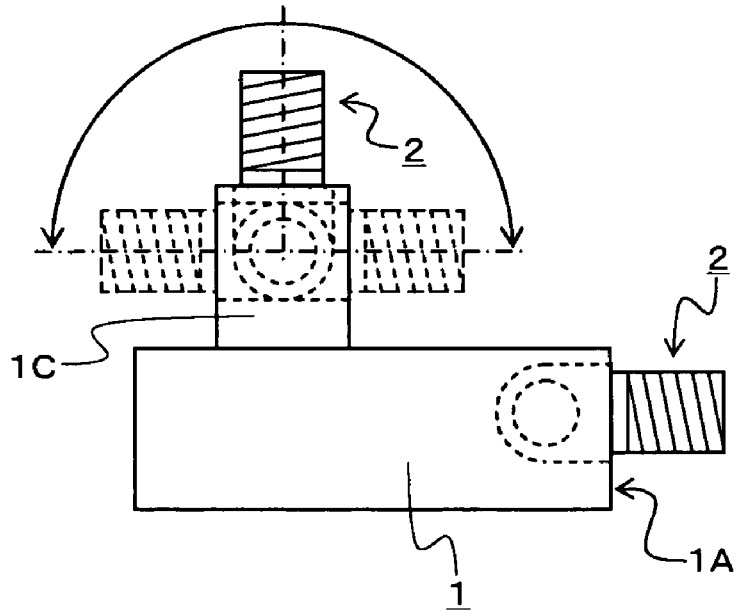
FIG. 13 is a schematic illustration for explaining an operation effect of the coaxial cable distributor of the present first embodiment, and FIGS. 13(*a*) and 13(*b*) are views for explaining a rotational range of the junction plug.
Figure 13:
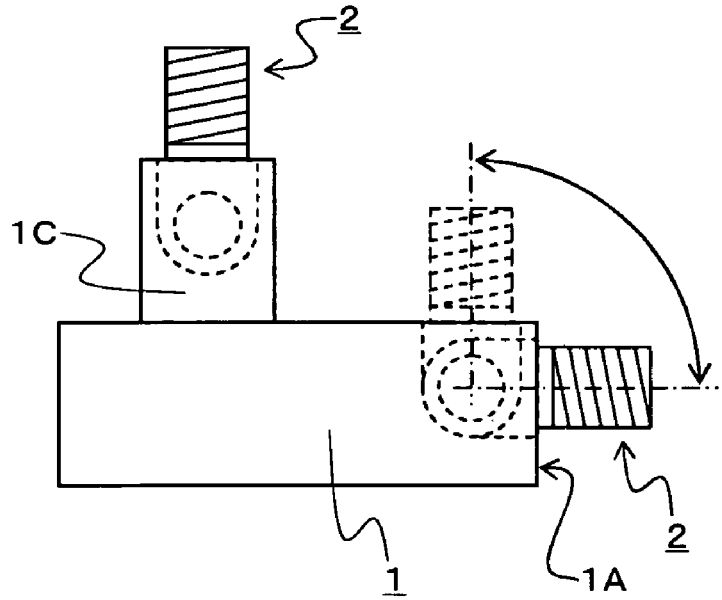
Figure 14:
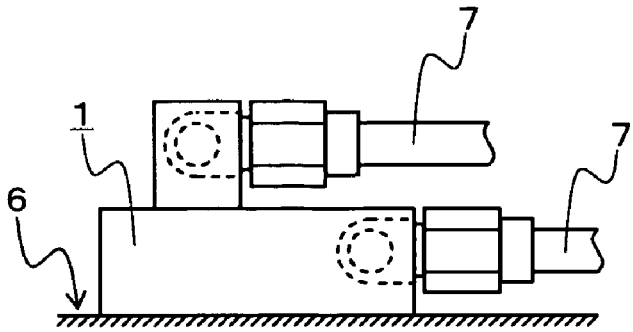
FIG. 14 is a schematic illustration for explaining an operation effect of the coaxial cable distributor of the present first embodiment, and FIG. 14(*a*) is a view for explaining one example of usage method, and FIG. 14(*b*) is a top view of FIG. 14(*a*)
Figure 14:
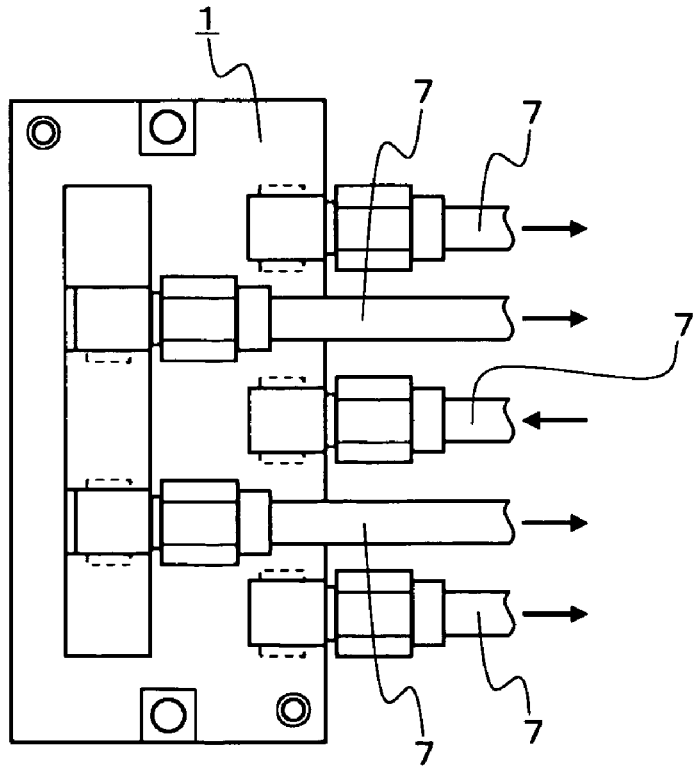
Figure 15:
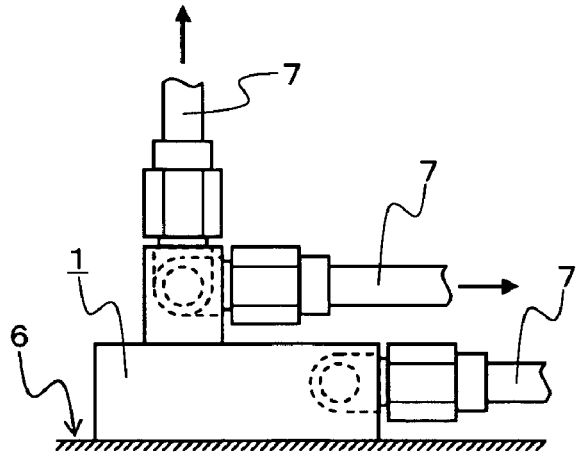
FIG. 15 is a schematic illustration for explaining an operation effect of the coaxial cable distributor of the present first embodiment, and FIGS. 15(*a*), 15(*b*), and 15(*c*) are views for explaining another example of usage method.
Figure 15:
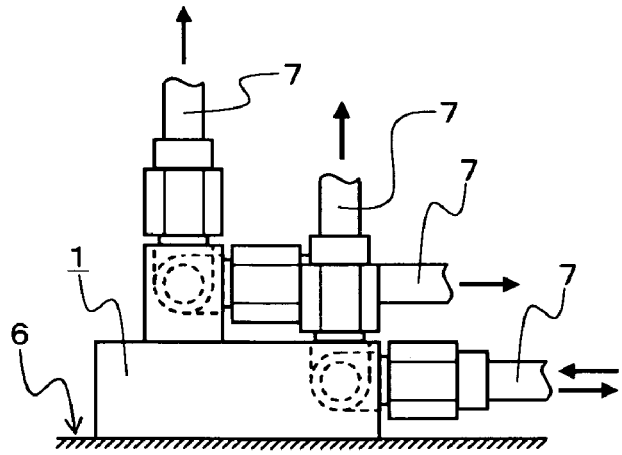
Figure 15:
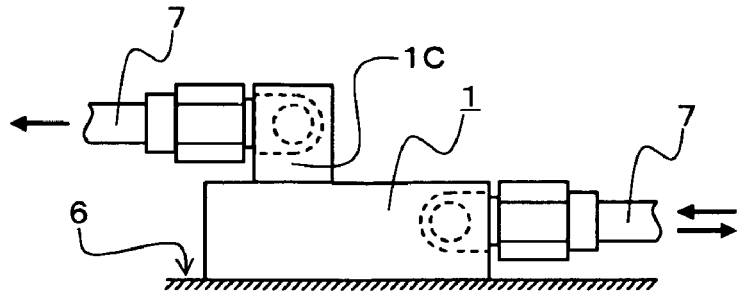
Figure 16:
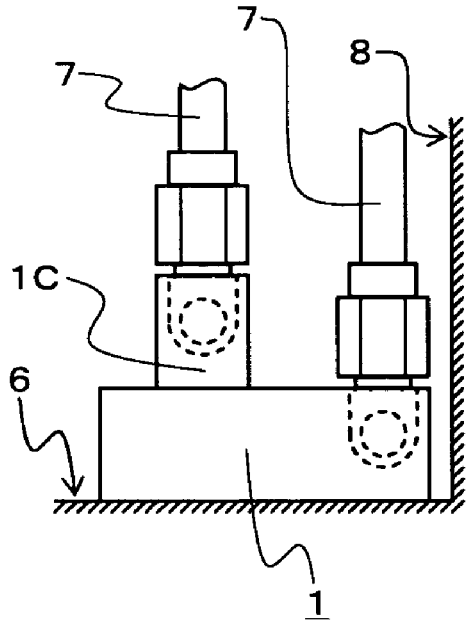
FIG. 16 is a schematic illustration for explaining an operation effect of the coaxial cable distributor of the present first embodiment, and FIG. 16 (*a*) is a view for explaining another example of usage method, and FIG. 16(*b*) is a right side view of the distributor of FIG. 16(*a*)
Figure 16:
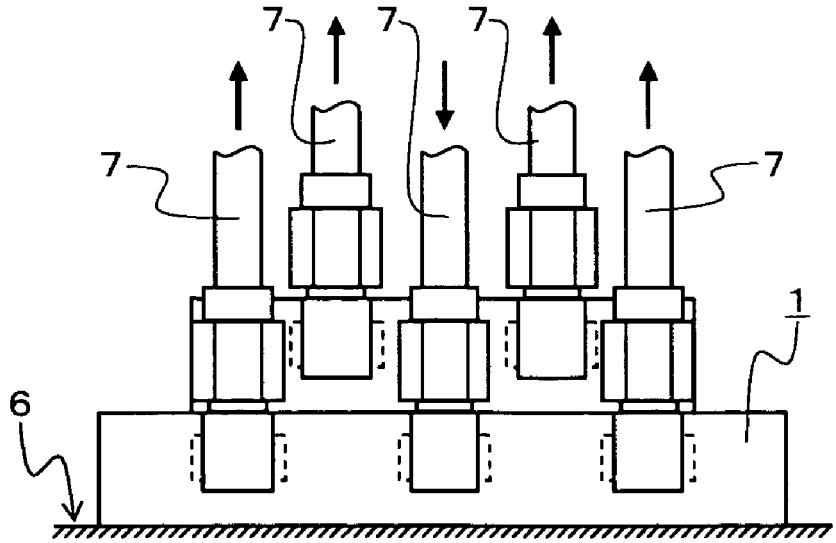

FIGS. 13 to 16 are schematic illustrations for explaining the operation effect of the coaxial cable distributor of the present first embodiment. FIGS. 13(*a*) and 13(*b*) are views for explaining the rotational range of the junction plug. FIG. 14(*a*) is a view for explaining one example of usage method. FIG. 14(*b*) is a top view of FIG. 14(*a*). FIGS. 15(*a*), 15(*b*), 15(*c*), and 16(*a*) are views for explaining another example of usage method, respectively. FIG. 16(*b*) is a right side view of the distributor of FIG. 16(*a*). The arrow mark shown in each of FIGS. 14(*b*), 15(*a*), 15(*b*), 15(*c*), and 16(*b*) is an arrow mark showing a transmitting direction of signals.

The coaxial cable distributor of the present first embodiment, as explained along with FIGS. 2 to 12, allows the projection 201C provided in the external contact 201 of the junction plug 2 to be borne and supported and fixed by the bearings 301A and 301B, which are provided in the bearing 1D of the casing 1 and the junction plug fixing bracket 3. Further, at this time, within the casing 1, the window 1E provided in the step 1C is opened in three directions, and the window 1E provided in the first surface 1A is opened in two directions. Hence, the junction plug 2 fitted to the step 1C of the casing 1, as shown in FIG. 13(*a*), can be rotated 180 degree with the projection 201C as an axis of rotation. Further, the junction plug 2 fitted to the first surface 1A of the casing 1, as shown in FIG. 13(*b*), can be rotated 90 degree with the projection 201C as an axis of rotation.

After the coaxial cable distributor of the present first embodiment is fitted to the wall surface and the like, when the coaxial cables are connected to the junction plug 2, for example, as shown in FIGS. 14(*a*) and 14(*b*), all the coaxial cables 7 can be led out in a direction parallel with the surface 6 fitted with the distributor. At this time, the connection end of each coaxial cable 7 can be changed as occasion demands, and for example, as shown in FIG. 14(*b*), from among three junction plugs provided in the first surface 1A of the casing 1, the center junction plug can be taken for use of an input, and the remaining four junction plugs can be taken for use of an output.

Further, in the coaxial cable distribute of the present first embodiment, in addition to the method shown in FIGS. 14(*a*) and 14(*b*), for example, as shown in FIG. 15(*a*), one of the junction plugs provided in the step 1C of the casing 1 can be directed to a direction vertical to the surface 6 fitted with the distributor. Besides, for example, as shown in FIG. 15(*b*), one of the junction plugs provided in the first surface 1A of the casing 1 can be also directed to the direction vertical to the surface 6 fitted with the distributor. Further, at this time, since each junction plug 2 can be rotated individually, as shown in FIGS. 14(*a*) and 14(*b*), even when all the junction plugs 2 are directed to the same direction, only when the coaxial cable 7 is connected to each junction plug 2 as shown in FIGS. 15(*a*) and 15(*b*), the direction of the junction plug 2 is changed, and therefore, operability can be enhanced at the time of connecting the coaxial cable 7.

Further, since the junction plug 2 provided in the step 1C of the casing 1 can be rotated 180 degree, as shown in FIG. 15(*c*), the coaxial cable 7 connected to the junction plug provided in the step 1C can be led in a direction reverse to the leading direction of the coaxial cable 7 connected to the junction plug provided in the first surface 1A of the casing 1.

Further, in addition to this, for example, as shown in FIGS. 16(*a*) and 16(*b*), in case a surface 8 vertical to a surface 6 in which the distributor is installed is in the vicinity of the distributor, the coaxial cable 7 connected to the junction plug 2 can be also led in a direction vertical to the surface 6 in which the distributor is installed.

If the coaxial cable distributor of the present first embodiment, in addition to other examples as shown in FIGS. 14 to 16, has each junction plug in a rotational range, it goes without saying that the leading direction of each coaxial cable 7 connected to each junction plug can be freely set.

For example, the junction plug 2 can be rotated, while maintaining mutual electrical connections between the external contacts 201 and the center contacts 202A. Hence, the coaxial cables 7 connected to each junction plug 2 can be put in a state not only parallel or vertical to the surface 6 installed with the distributor, but also, for example, in a state declined 45 degree.

As described above, according to the coaxial cable distributor of the present first embodiment, since the junction plug 2 fitted to the casing 1 can be rotated, a degree of freedom of the leading direction of the coaxial cable is enhanced. Hence, comparing to the conventional distributor, its versatility is enhanced.

Further, since the junction plug 2 can be rotated, in case a distance between the surface fitted with the distributor such as a wall surface and the like and the junction plug 2 is short, and even in case plural junction plugs are lined up and the interval between the junction plugs is narrow, operability is good at the time of connecting the coaxial cable to the junction plug 2.

Further, since the junction plug 2 is rotated, the bending of the coaxial cable connected to the junction plug 2 can be kept to a minimum. Hence, generation of noises and breaking of the cable due to the bending of the coaxial cable can be prevented.

Second Embodiment

Figure 17:
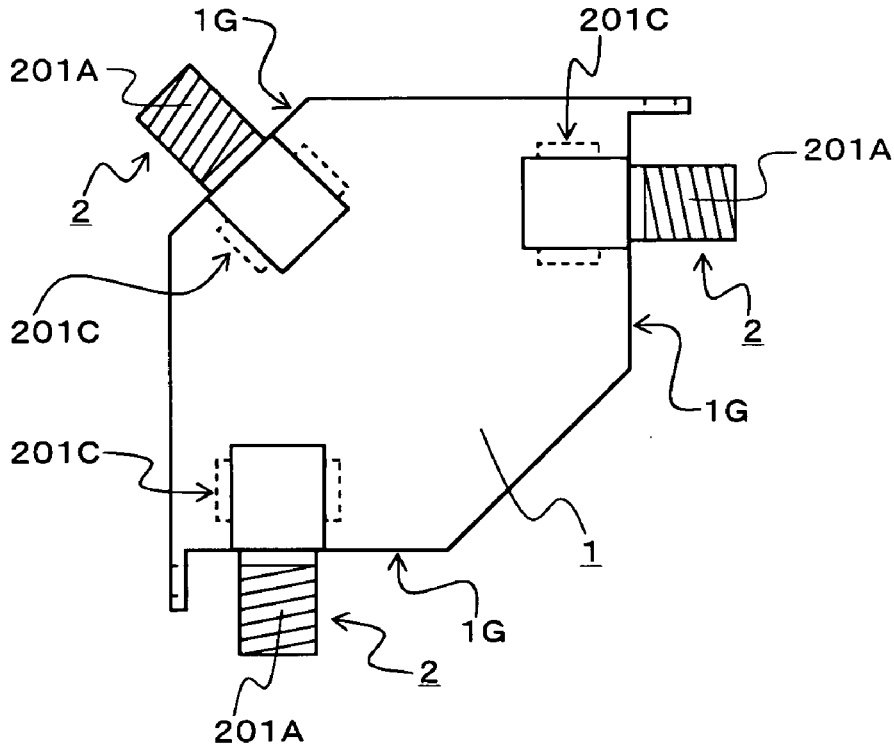
FIG. 17 is a schematic illustration showing a schematic structure of the coaxial cable distributor of a second embodiment according to the present invention, and FIG. 17(*a*) is a top plan view of the distributor, and FIG. 17 (*b*) is a front view of FIG. 17(*a*)
Figure 17:
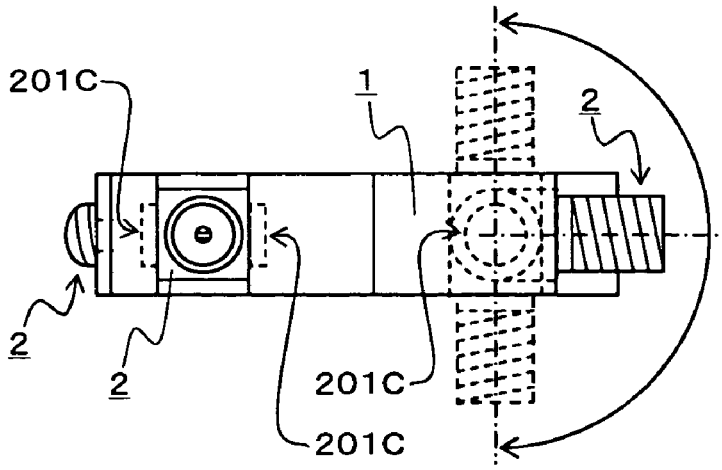

FIG. 17 is a schematic illustration showing a schematic structure of a coaxial cable distributor of a second embodiment of the present invention. FIG. 17(*a*) is a top view of the distributor, and FIG. 17(*b*) is a front view of FIG. 17(*a*).

The coaxial cable distributor of the present second embodiment, as shown in FIGS. 17(*a*) and 17(*b*), are fitted with three terminals (hereinafter referred to as junction plug) 2 connecting the coaxial cable on a surface of a metallic casing 1 having a hollow therein. Since the structure of each junction plug 2 is the same as the junction plug 2 as described in the first embodiment, the description thereof will be omitted.

Further, the coaxial cable distributor of the present second embodiment is, for example, a distributor used by being fitted to a ceiling or a floor corner (corner portion), and the casing 1, as shown in FIG. 17(*a*), has a shape such as providing a flat surface (hereinafter referred to as a third surface) 1G by cutting an apex angle of an isosceles triangle. Further, the interior of the casing 1 is provided with a hollow, and this hollow is provided with a printed circuit board for electrically connecting the center contacts (contact pin) of each junction plug to each other. Further, at this time, since each junction plug 2, for example, may be fixed to the casing 1 by using the first junction plug fixing bracket 3A as described in the first embodiment, the detailed description thereof will be omitted. Further, at this time, in the coaxial cable distributor of the present second embodiment, different from the first embodiment, if a portion fitted with the junction plug 2 of the casing 1 is provided with a window opened in three directions, as shown in FIG. 17(*b*), each junction plug 2 can be rotated 180 degree.

Figure 18:
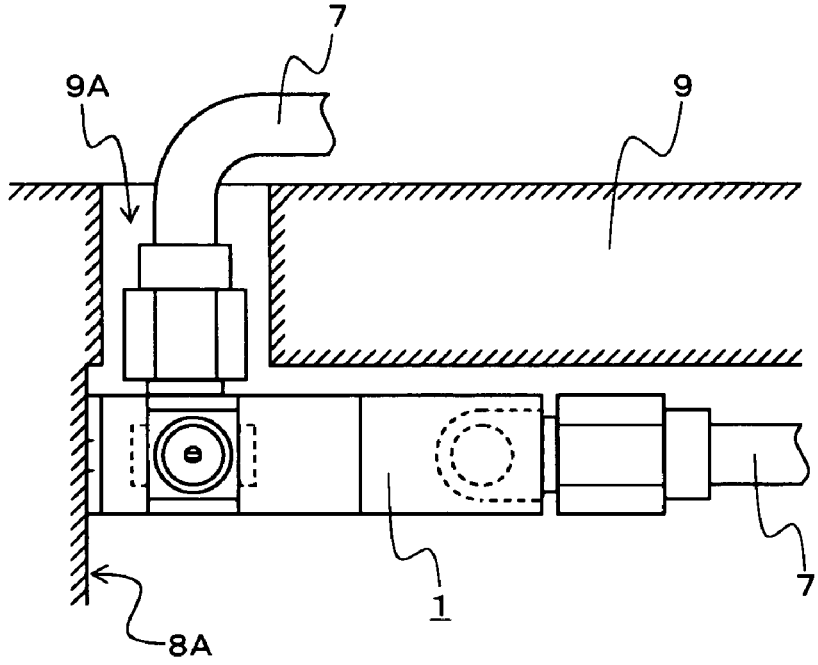
FIG. 18 is a schematic illustration for explaining a usage method of the coaxial cable distributor of the present second embodiment, and FIGS. 18(*a*) and 18(*b*) are views for explaining a first usage example.
Figure 18:
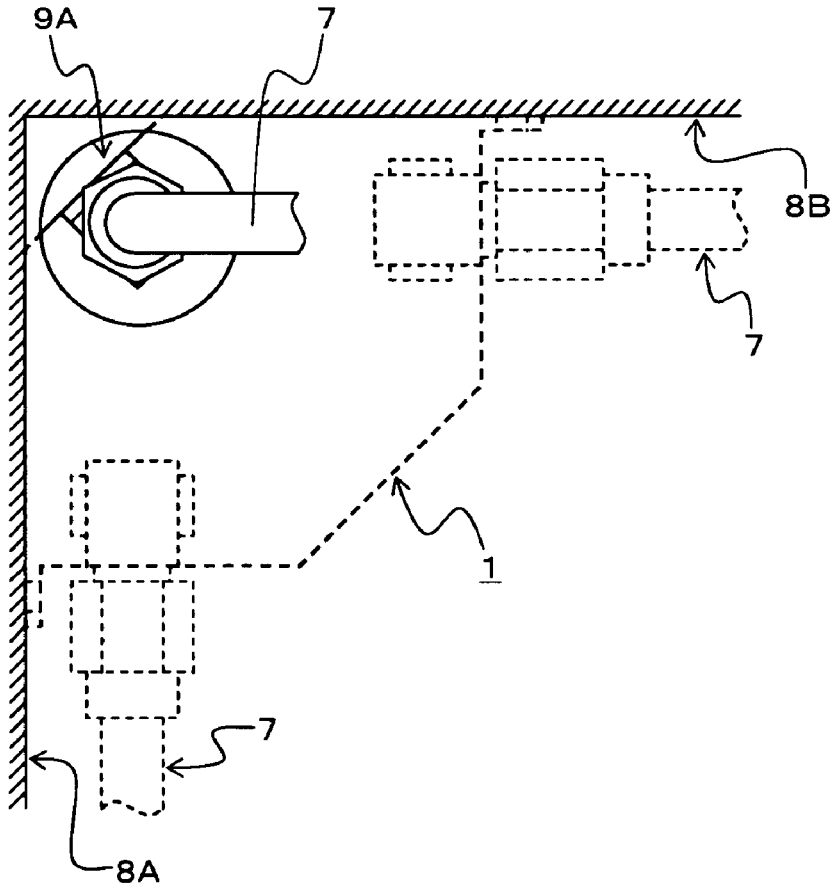
Figure 19:
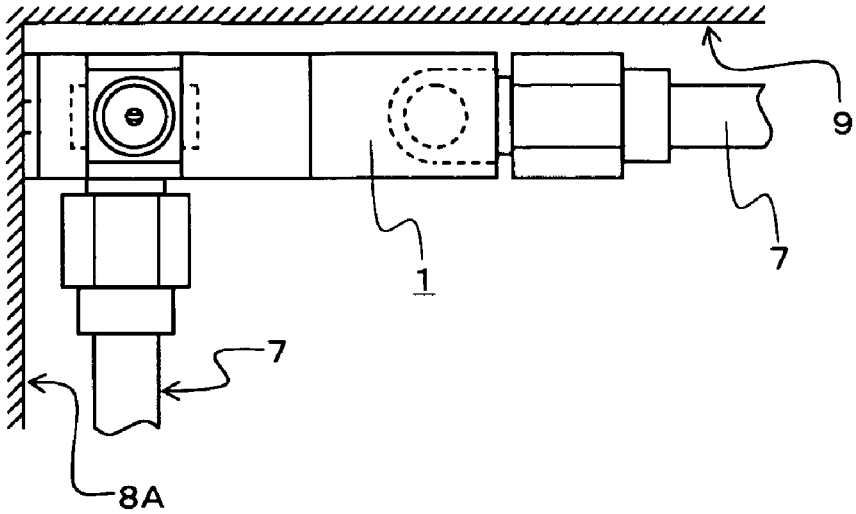
FIG. 19 is a schematic illustration showing a usage method of the coaxial cable distributor of the present second embodiment, and FIGS. 19(*a*) and 19(*b*) are views for explaining a second usage example.
Figure 19:
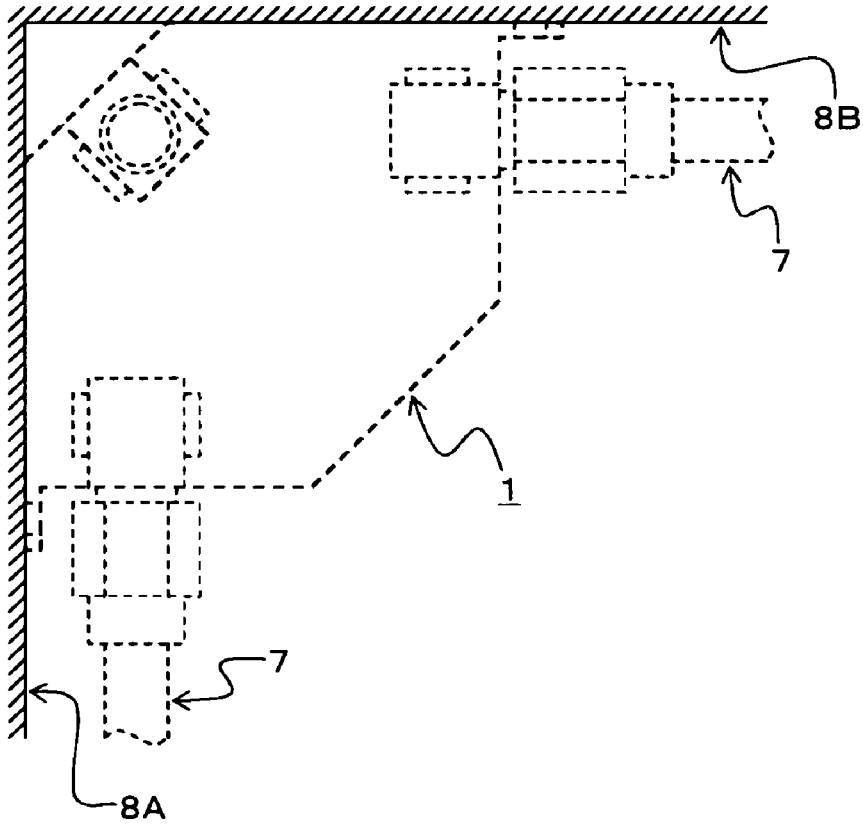
Figure 20:
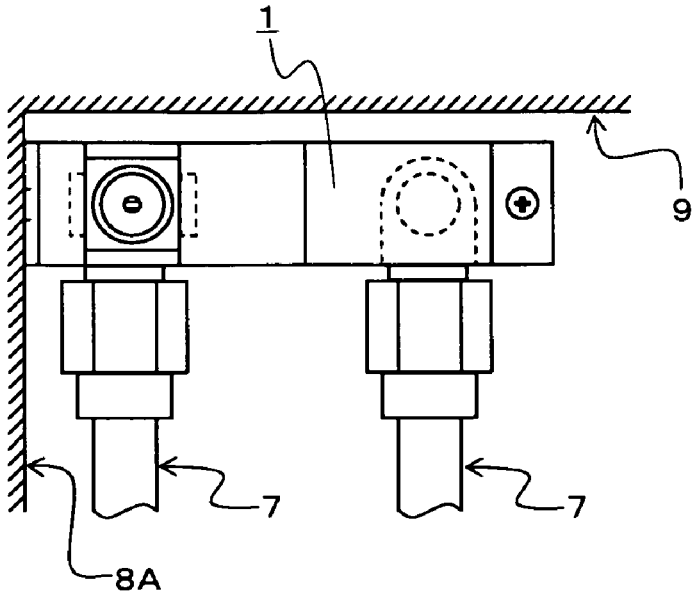
FIG. 20 is a schematic illustration for explaining a usage method of the coaxial cable distributor of the present second embodiment, and FIGS. 20(*a*) and 20(*b*) are views for explaining a third usage example.
Figure 20:
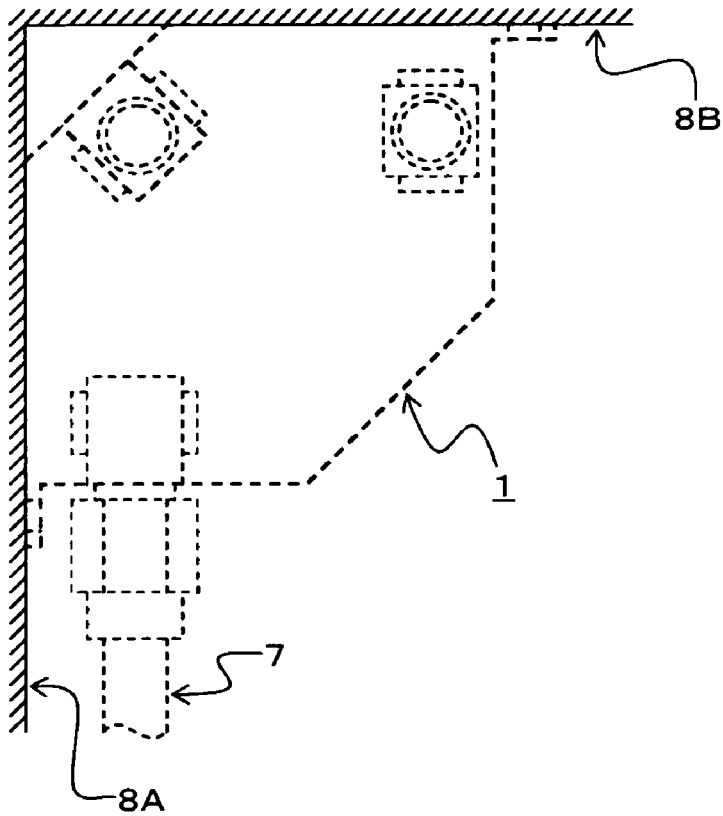

FIGS. 18 to 20 are schematic illustrations for explaining an example of usage method of the coaxial cable distributor of the present second embodiment. FIGS. 18(*a*) and 18(*b*) are views for explaining a first usage example, and FIGS. 19(*a*) and 19(*b*) are views for explaining a second usage example, and FIGS. 20(*a*) and 20(*b*) are views for explaining a third usage example.

In case the coaxial cable distributor of the present second embodiment, for example, as shown in FIGS. 18(*a*) and 18(*b*), fits the distributor on the corner of the ceiling 9, a pass through hole 9A is provided in the ceiling 9, and one piece of the junction plug 2 is connected to the coaxial cable 7 laid down in the rear side of the ceiling 9, and the coaxial cable 7 connected to the remaining two junction plugs can be connected to the terminals of the indoor TV receivers and the like. At this time, the coaxial cable 7 at the indoor side, for example, as shown in FIGS. 18(*a*) and 18(*b*), can be allowed to crawl along the joints of the walls 8A and 8B of the ceiling 9. Further, at this time, similarly to the conventional distributor, when the junction plug 2 is fixed to the casing 1, operability is poor at the time of connecting the coaxial cable 7 to the junction plug 2. In the meantime, in case of the distributor of the present second embodiment, since the junction plug 2 can be rotated, when the coaxial cable 7 is connected, the junction plug 2 can be directed in a direction vertical to the ceiling 9, that is, in a normal direction of the ceiling 9, and therefore, operability can be enhanced at the time of connecting the coaxial cable 7.

Further, though the illustration is omitted, since the junction plug 2 connected with the coaxial cable 7 of the indoor side can be also directed in a normal direction of the ceiling 9, even when one or both sides of the coaxial cable 7 of the indoor side are desired to crawl along the joints of the walls 8A and 8B, the bending of the coaxial cable 7 can be kept to a minimum.

Further, when the coaxial cable distributor of the present second embodiment is used, not only the usage method as shown in FIGS. 18(*a*) and 18(*b*) is followed, but also, for example, as shown in FIGS. 19(*a*) and 19(*b*), and 20(*a*) and 20(*b*), each of the coaxial cable 7 connected to each junction plug 2 may be allowed to crawl along the joint of the ceiling 9 and the wall 6A, the joint between the ceiling 9 and the wall 6B, and the joint between the wall 6A and the wall 6B. In this case also, by allowing the junction plug 2 to rotate, the bending of the coaxial cable connected to each junction plug 2 can be kept to a minimum.

As described above, according to the coaxial cable distributor of the present second embodiment, since the junction plug 2 fitted to the casing 1 can be rotated, a degree of freedom of the leading direction of the coaxial cable connected to the junction plug 2 is enhanced. Hence, comparing to the conventional distributor, its versatility is enhanced.

Further, since the junction plug 2 can be rotated, in case a distance between the surface fitted with the distributor such as a wall surface and the junction plug 2 is short, and even in case plural junction plugs are lined up and the interval between the junction plugs is narrow, operability is good at the time of connecting the coaxial cable to the junction plug 2.

Further, since the junction plug 2 is rotated, the bending of the coaxial cable connected to the junction plug 2 can be kept to a minimum. Hence, generation of noises and breaking of the cable due to the bending of the coaxial cable can be prevented.

Third Embodiment

Figure 21:
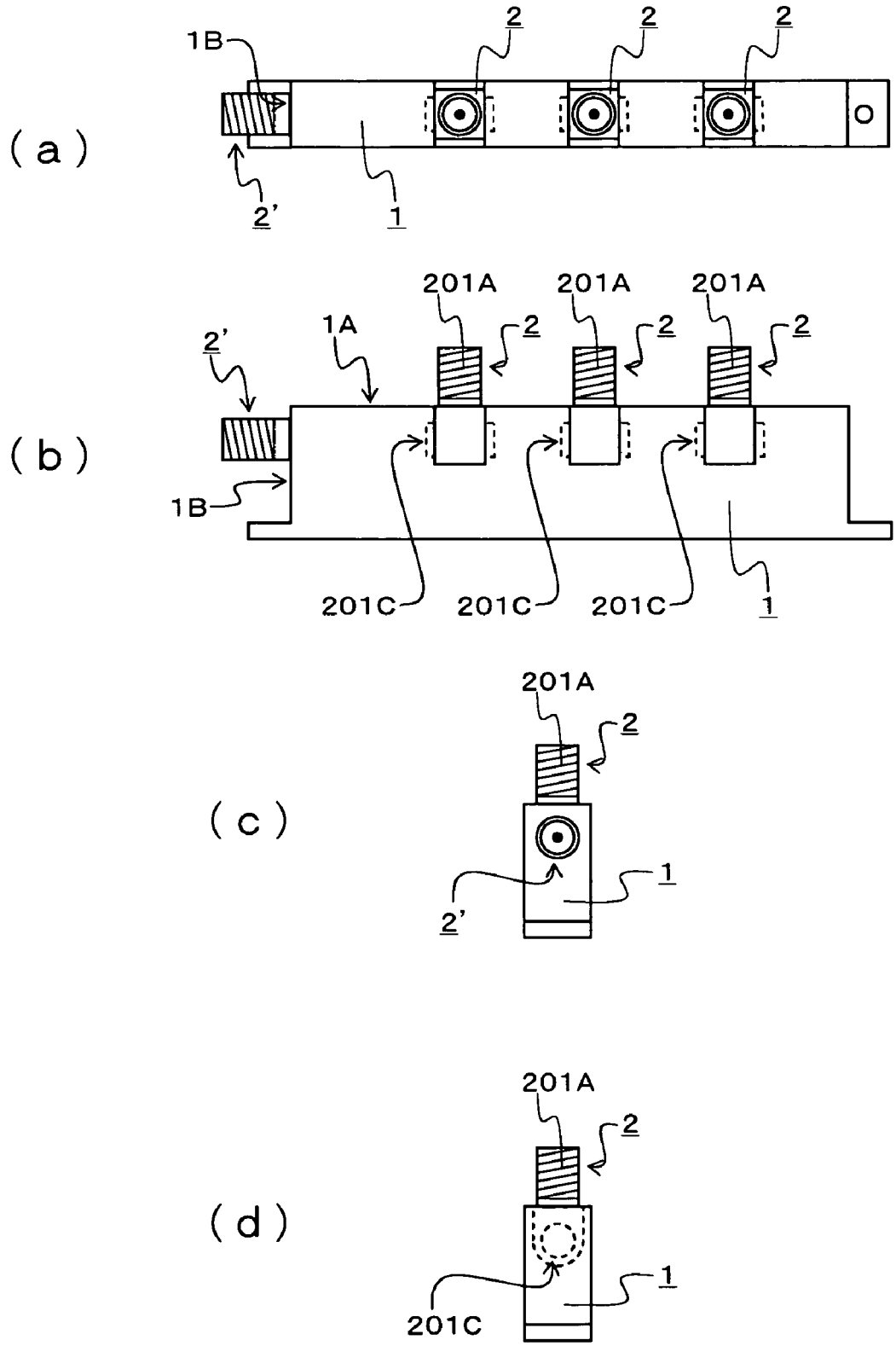
FIG. 21 is a schematic illustration showing a schematic structure of the coaxial cable distributor of a third embodiment according to the present invention, and FIG. 21(*a*) is a top plan view of the distributor, and FIG. 21 (*b*) is a front view of FIG. 21(*a*), and FIG. 21(*c*) is a left side view of FIG. 21(*b*), and FIG. 21(*d*) is a right side view of FIG. 21(*b*)
Figure 22:
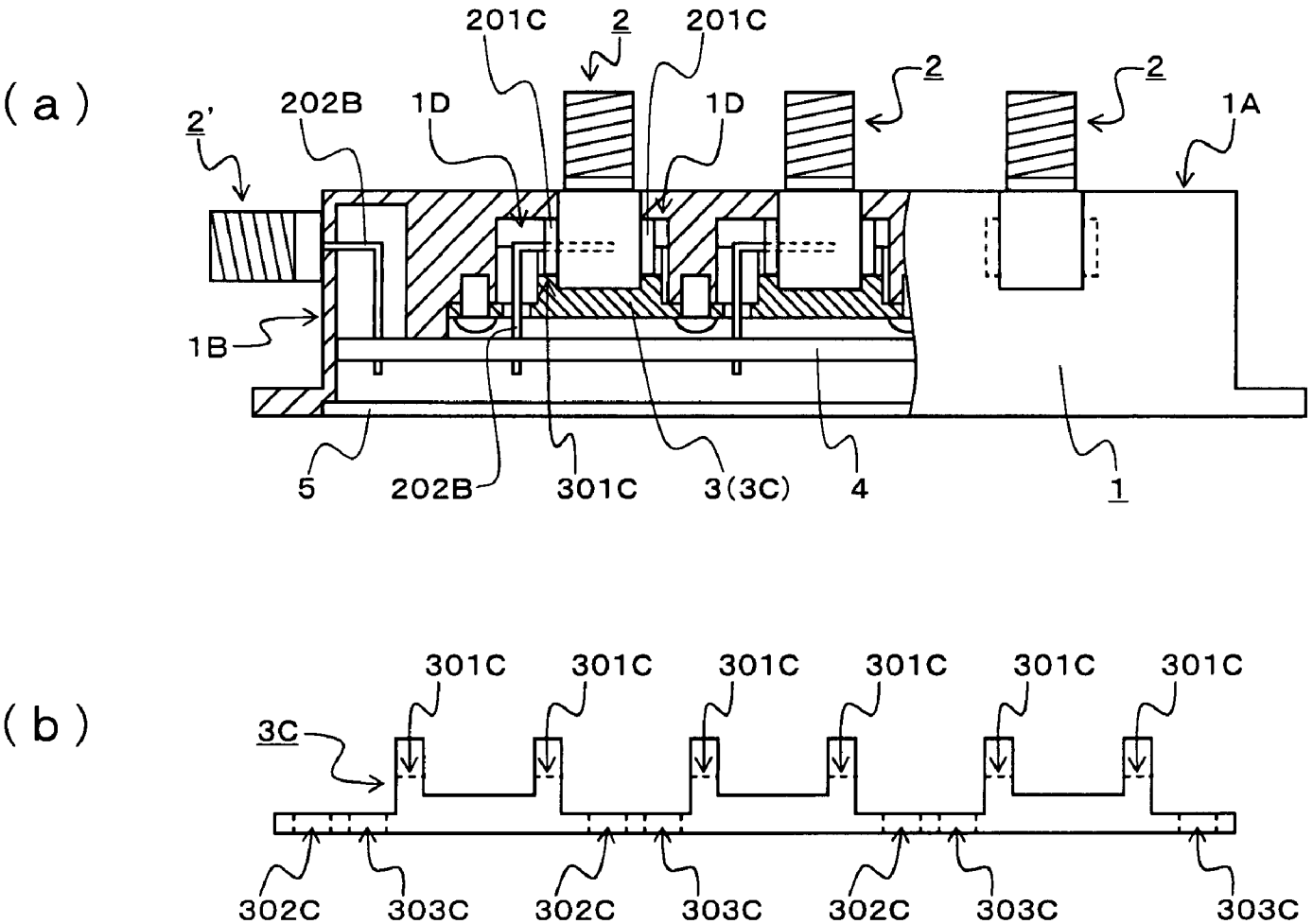
FIG. 22 is a schematic illustration showing a schematic structure of the coaxial cable distributor of the present third embodiment, and FIG. 22(*a*) is a view showing the internal structure of the distributor, and FIG. 22(*b*) is a view showing a structure of the junction plug fixing bracket.

FIGS. 21 and 22 are schematic illustrations showing a schematic structure of a coaxial cable distributor of a third embodiment according to the present invention. FIG. 21(*a*) is a top plan view of the distributor, and FIG. 21(*b*) is a front view of FIG. 21(*a*), and FIG. 21(*c*) is a left side view of FIG. 21(*b*), and FIG. 21(*d*) is a right side view of FIG. 21(*b*). FIG. 22(*a*) is a view showing the internal structure of the distributor, and, FIG. 22(*b*) is a view showing a structure of a junction plug fixing bracket.

A coaxial cable distributor of the present third embodiment, as shown in FIGS. 21(*a*) and 21(*b*), 21(*c*), and 21(*d*), is fitted with four terminals (hereinafter referred to as junction plug) 2 for connecting a coaxial cable on the surface of a metal casing 1. From among the junction plugs 2, since three junction plugs 2 fitted to a first surface 1A of the casing 1 are of the same structure as the junction plug 2 described in the first embodiment, the detailed description thereof will be omitted. Since a junction plug 2' fitted to a second surface 1B contacting the first surface 1A of the casing 1 is of the same structure as the junction plug fitted to the conventional distributor, the detailed description thereof will be omitted.

Further, the casing 1 has a hollow therein, and the external contacts 201 of each junction plug 2 provided in the first surface 1A of the casing 1, as shown in FIG. 22(*a*), are electrically connected to each other by the casing 1. At this time, the external contact 201 and the casing 1 are connected so as to support a projection 201C provided in a hinged end of the external contact 1. Further, at this time, a joint between the casing 1 and the projection 201C is fixed by a junction plug fixing bracket 3. The junction plug fixing bracket 3, for example, as shown in FIG. 22(*b*), is provided with a bearing 301C bearing each projection 201C provided in the three junction plugs 2 and an opening 303C allowing each contact pin 202B to pass through on one surface of the metal plate. Since the fixing method at this time is the same as the fixing method by the second junction plug fixing bracket 3B described in the first embodiment, the detailed description thereof will be omitted.

Further, the center contacts 202A of each junction plug 2 provided in the first surface 1A of the casing 1 are electrically connected to each other by connecting a contact pin 202B provided in each junction plug 2 to a printed circuit board 4 provided in the hollow of the casing 1. At this time, the casing 1 is opened in one surface direction, and from this opened surface, the printed circuit board 4 is inserted, and the conductor patterns of the contact pin 202B and the printed circuit board 4 are soldered, and after that, the opened surface is fitted with a back cover 5.

Figure 23:
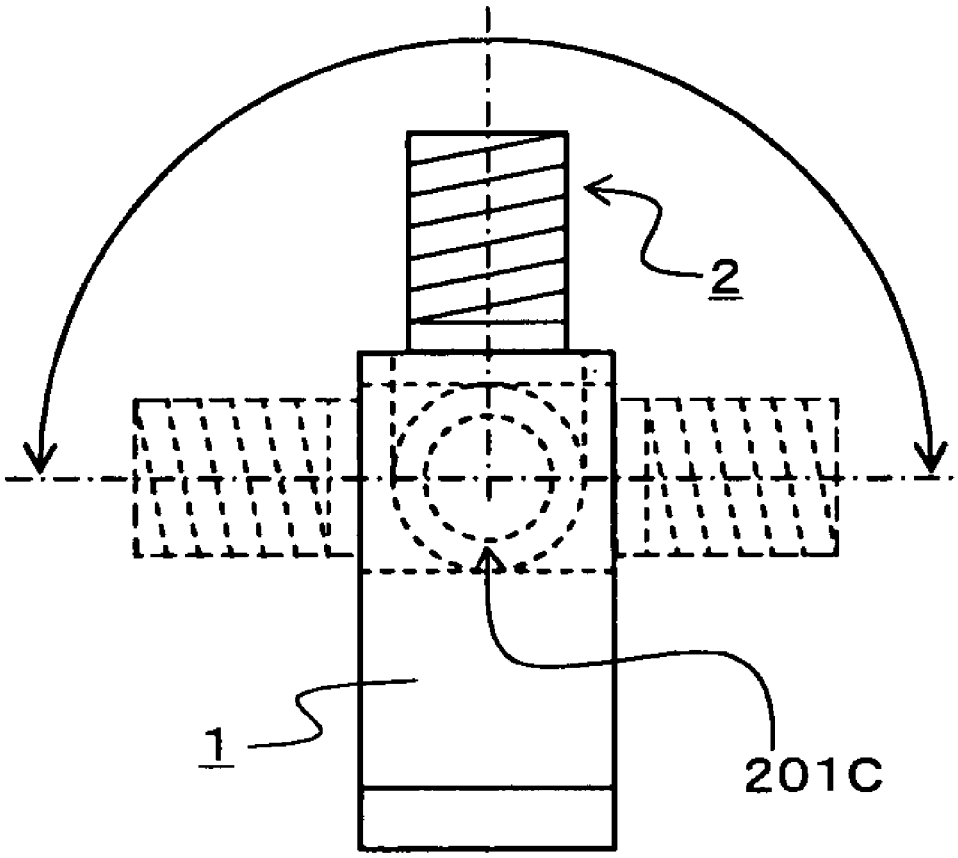
FIG. 23 is a schematic illustration for explaining the operation effect of the coaxial cable distributor of the present third embodiment.

FIG. 23 is a schematic illustration for explaining the operation effect of the coaxial cable distributor of the present third embodiment.

In the coaxial cable distributor of the present third embodiment, three junction plugs 2 provided on a first surface 1A of the casing 1, as shown in FIG. 23, can be rotated in the range of 180 degree, respectively. Hence, when the coaxial cable is connected to the junction plug 2, all the cables can be led out in the same direction, and one or two cables can be led out in a reverse direction or in a vertical direction.

Further, in case the interval among three junction plugs provided on the first surface 1A of the casing 1 is narrow, and as conventionally, when these plugs are fixed to the casing 1, operability is poor at the time of connecting the coaxial cable to a center junction plug 2. In the meantime, in case of the coaxial cable distributor of the present third embodiment, since the junction plug 2 is rotated, if the center junction plug 2 is directed in a direction different from the junction plugs at both sides, the coaxial cable can be easily connected. Further, when the coaxial cable connected to each junction plug 2 is led out also in a direction parallel with the surface fitted with the coaxial cable distributor, only when the coaxial cable is connected, the junction plug 2 can be directed in a direction vertical to the surface fitted with the distributor, and the coaxial cable can be easily connected.

As described above, according to the coaxial cable distribute of the present third embodiment, since the junction plug 2 fitted to the casing 1 can be rotated, a degree of freedom of the leading direction of the coaxial cable is enhanced. Hence, comparing to the conventional distributor, its versatility is enhanced.

Further, since the junction plug 2 can be rotated, in case a distance between the surface fitted with the distributor such as a wall surface and the like and the junction plug 2 is short, and also even in case plural junction plugs are lined up and the interval between the junction plugs is narrow, operability is good at the time of connecting the coaxial cable to the junction plug 2.

Further, since the junction plug 2 is rotated, the bending of the coaxial cable connected to the junction plug 2 can be kept to a minimum. Hence, generation of noises and breaking of the cable due to the bending of the coaxial cable can be prevented.

Figure 24:
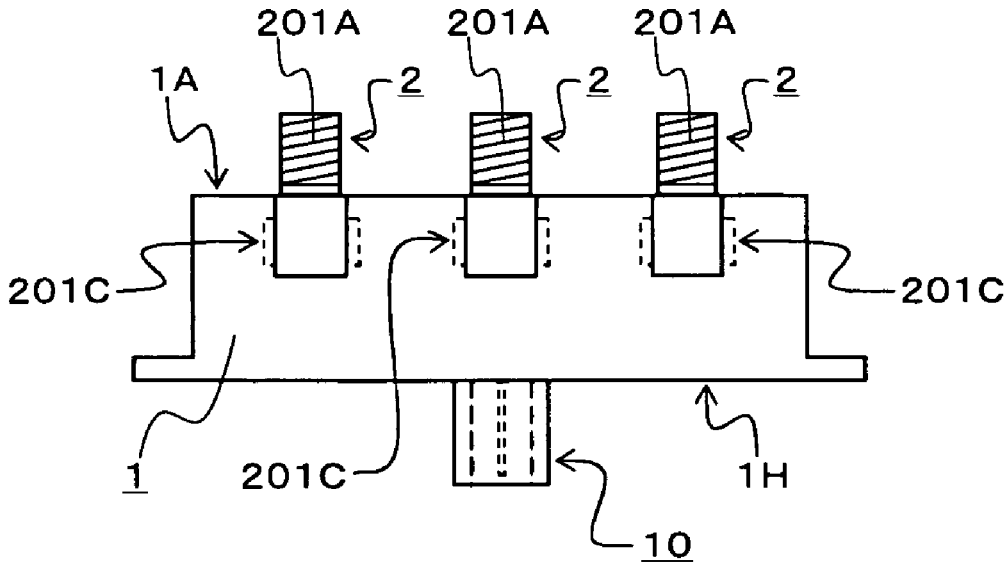
FIG. 24 is a schematic illustrating for explaining an application example of the coaxial cable distributor of the third embodiment, and FIG. 24(*a*) is a front view showing an example of the distributor, and FIG. 24(*b*) is a right side view of FIG. 24(*a*)
Figure 24:
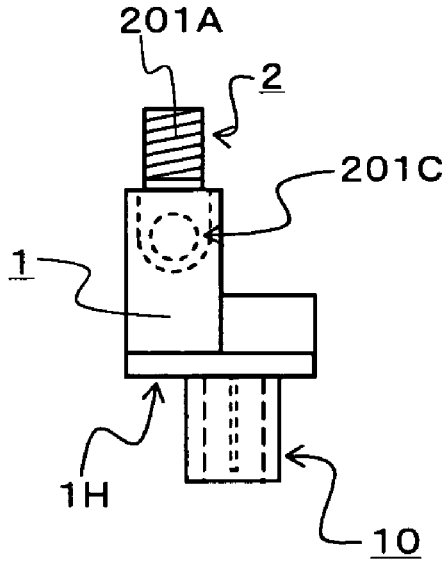
Figure 25:
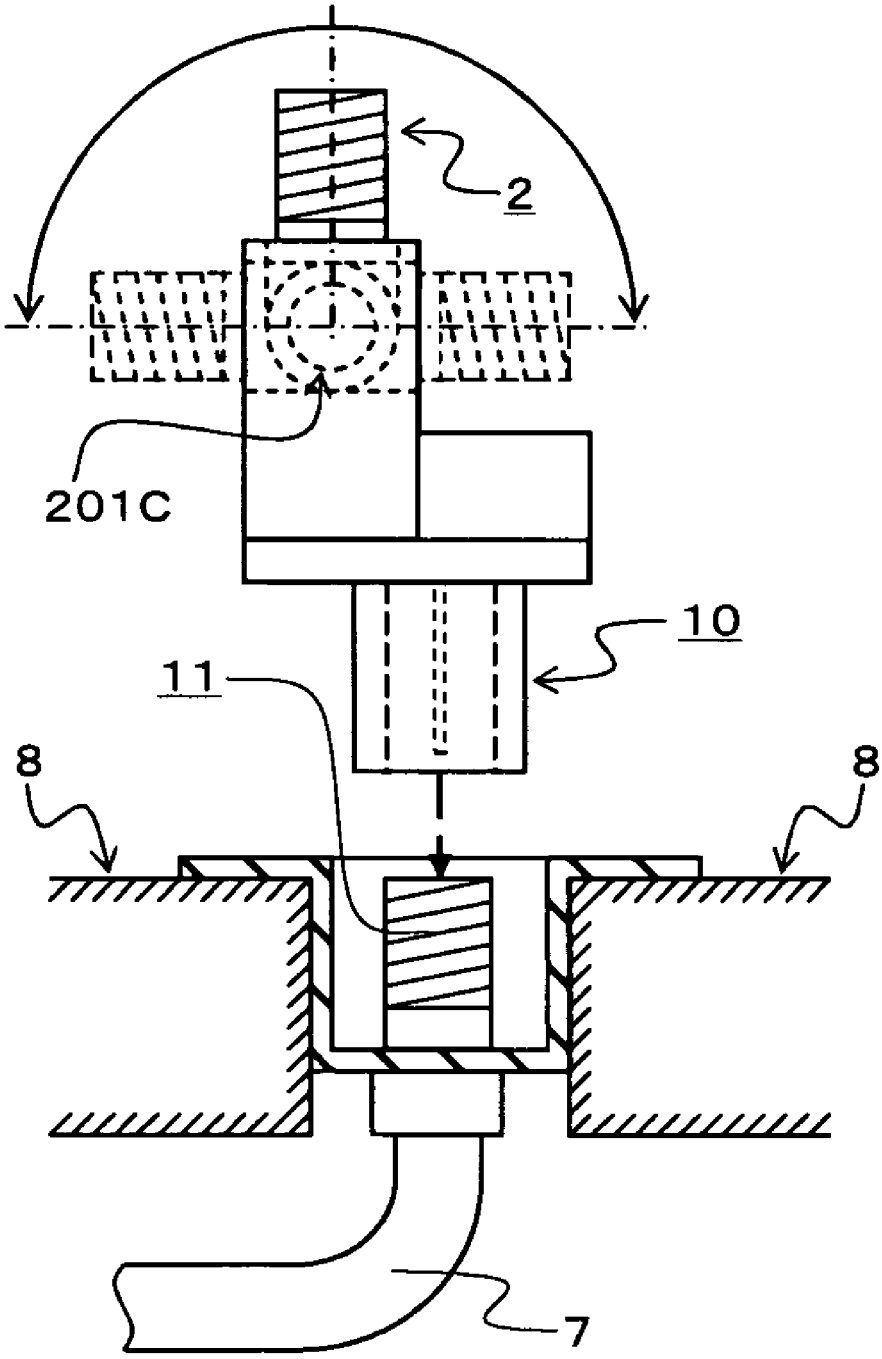
FIG. 25 is a schematic illustration for explaining an application example of the coaxial cable distributor of the third embodiment, and is a view showing a usage example.

FIGS. 24 and 25 are schematic illustrations for explaining application examples of the coaxial cable distributor of the third embodiment. FIG. 24(*a*) is a front view showing an example of the distributor, and FIG. 24 (*b*) is a right side view of FIG. 24(*a*). FIG. 25 is a view showing a usage example.

In the third embodiment, as shown in FIG. 21(*b*), while a distributor has been shown as an example, in which the second surface 1B contacting the surface (first surface) 1A provided with the rotating junction plugs 2 is provided with another junction plug 2', the embodiment is not limited to such an example, but as shown in FIGS. 24(*a*) and 24(*b*), the embodiment may be a distributor provided with another junction plug 10 on the rear surface 1H of the first surface 1A. At this time, the junction plug 10 provided on the rear surface 1H of the first surface is, for example, rendered a male type junction plug.

While the coaxial cable distributor described in the third embodiment is, for example, a distributor presumed to be used when the coaxial cable connected to the TV terminal provided on the indoor wall surface is distributed to the periphery of the TV receiver and the like, it is not limited to such a distributor, but for example, there exists a distributor which distributes directly from the TV terminal provided on the wall surface. At this time, since the TV terminal provided on the wall surface and the like is, in general, a male type terminal, the male type terminal is required for the distributor. Hence, if the rear surface 1H of the surface provided with the rotating junction plug 2 of the casing 1 is provided with the male type junction plug 10, as shown in FIG. 25, the male type junction plug 10 can be connected to a TV terminal 11 embedded inside the wall surface 8, and then, the casing 1 can be fixed to the wall surface 8 as it is. That is, by using the distributor as shown in FIGS. 24(*a*) and 24(*b*), one TV terminal embedded inside the wall surface 8 can be increased to three TV terminals. Further, at this time, since the three TV terminals, as described in the third embodiment, can be independently rotated 180 degree, respectively, the versatility thereof is high, and moreover, the connection of the coaxial cable is easy. Further, generation of noises and disconnection of the cable due to bending of the coaxial cable can be also prevented.

Fourth Embodiment

Figure 26:
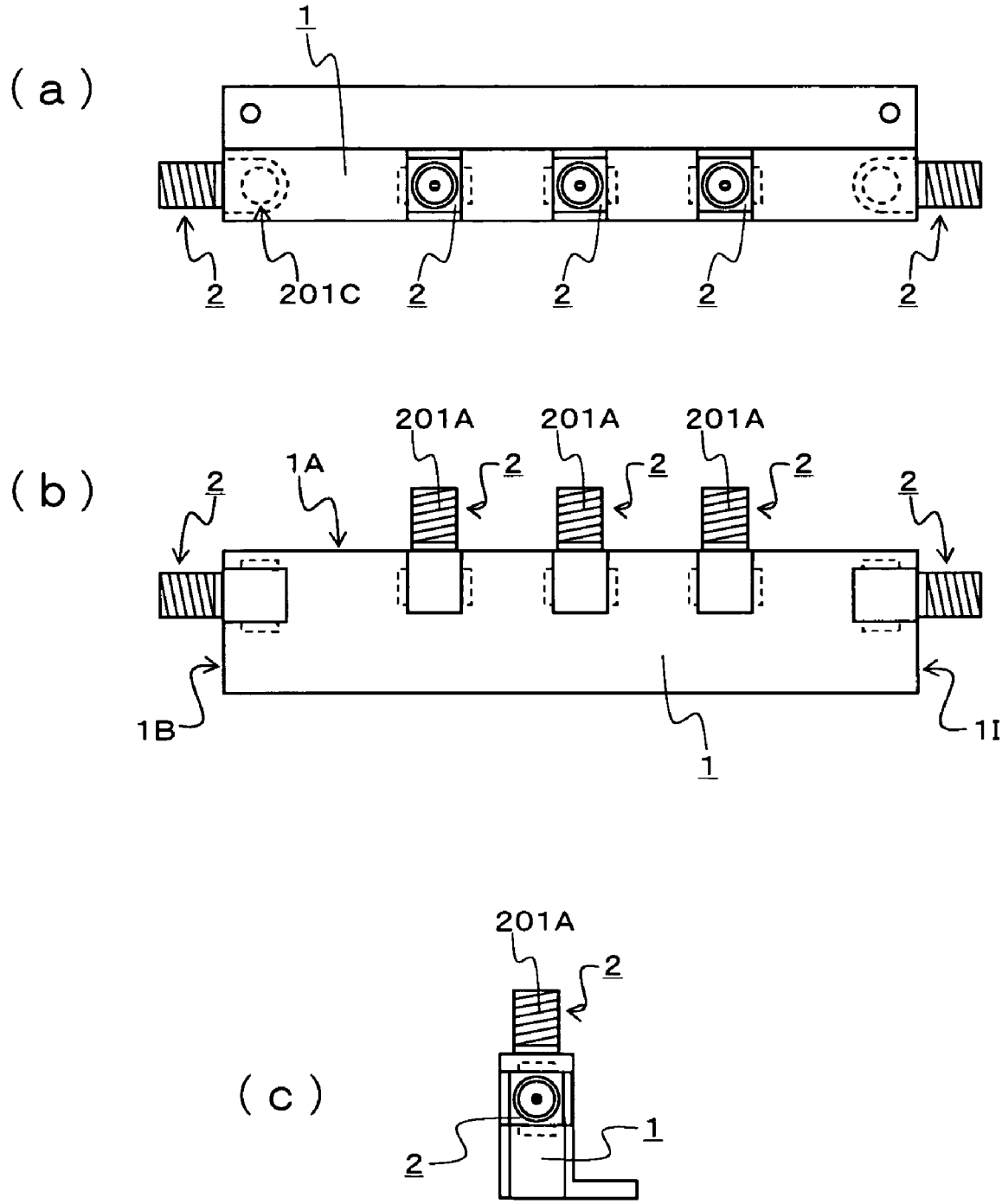
FIG. 26 is a schematic illustration showing a schematic structure of a coaxial cable distributor of a fourth embodiment according to the present invention, and FIG. 26(*a*) is a top plan view of the distributor, and FIG. 26(*b*) is a front view of FIG. 26(*a*), and FIG. 26(*c*) is a right side view of FIG. 26(*b*)
Figure 27:
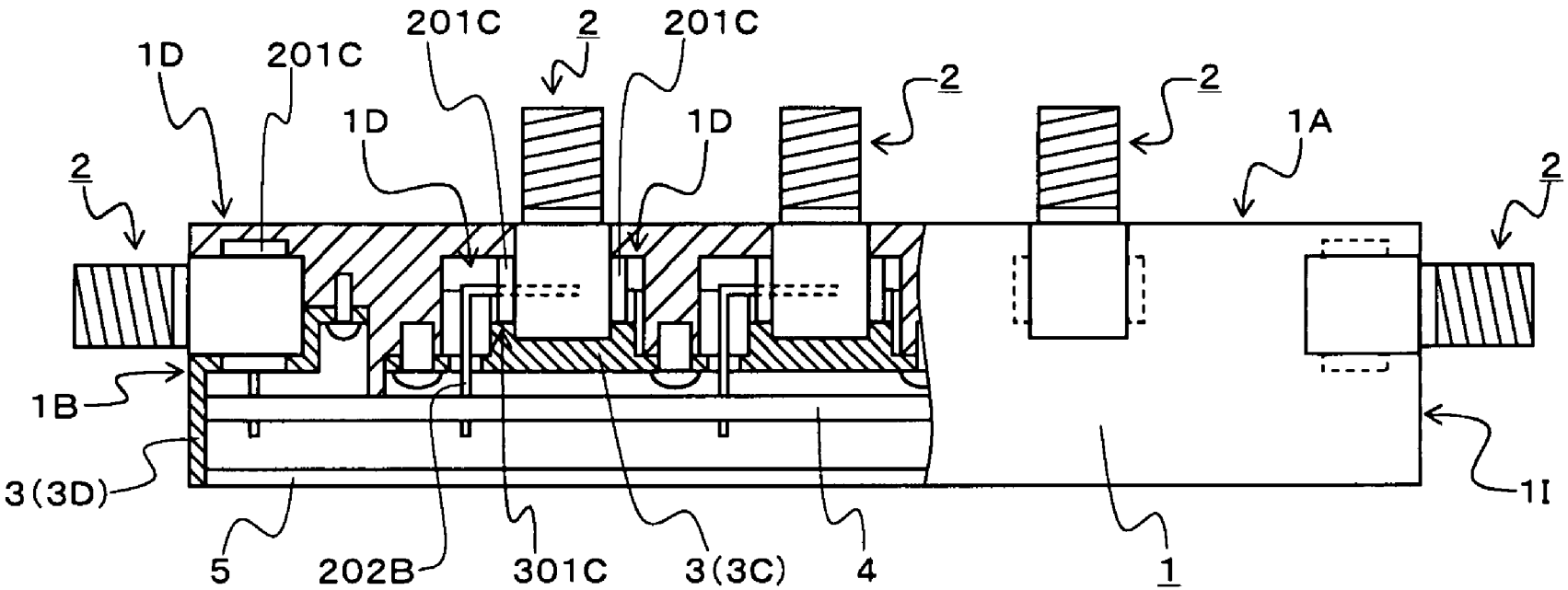
FIG. 27 is a schematic illustration showing a schematic structure of the coaxial cable distributor of the present fourth embodiment, and is a view showing the internal structure of the distributor.
Figure 28:
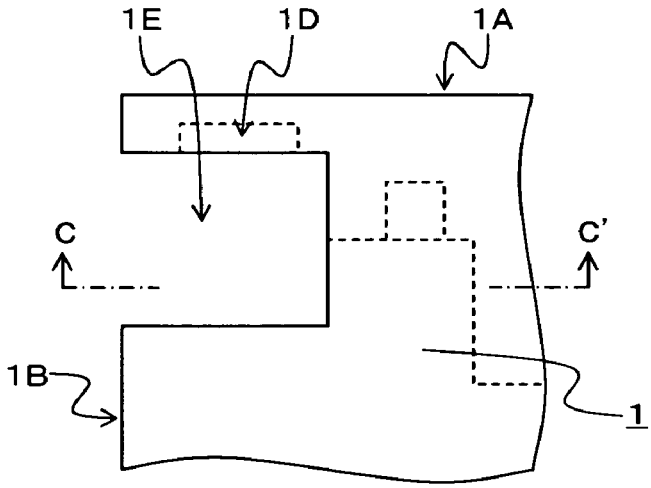
FIG. 28 is a schematic illustration showing a schematic structure of the coaxial cable distributor of the present fourth embodiment, and FIG. 28(*a*) is a fragmentary front view of a junction plug fitting of the casing, and FIG. 28(*b*) is a left side view of FIG. 28(*a*), and FIG. 28(*c*) is a bottom view seen from the line C to C' of FIG. 28(*a*)
Figure 28:
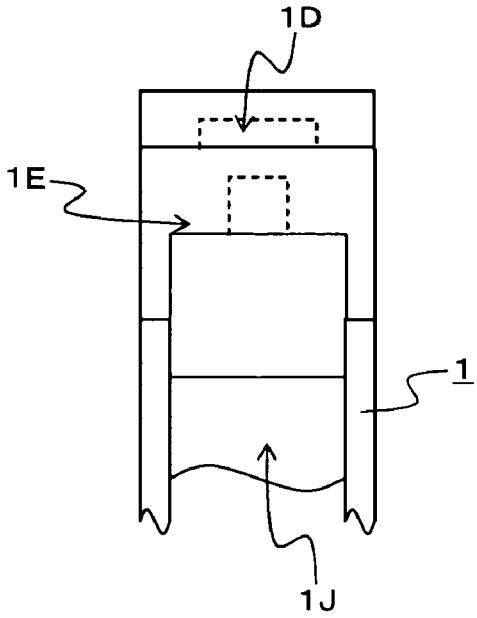
Figure 28:
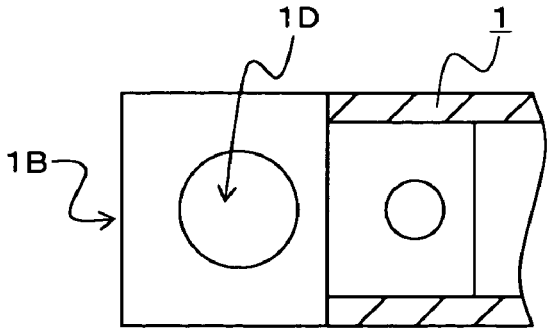
Figure 29:
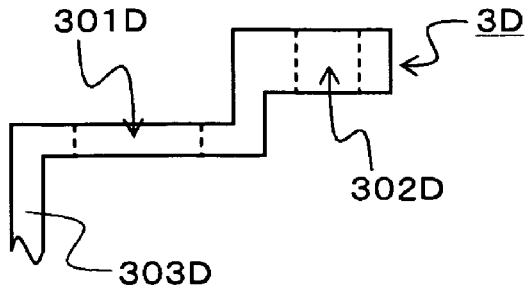
FIG. 29 is a schematic illustration showing a schematic structure of the coaxial cable distributor of the present fourth embodiment, and FIG. 29(*a*) is a fragmentary view of the junction plug fixing bracket, and FIG. 29(*b*) is a left side view of FIG. 29(*a*), and FIG. 29(*c*) is a rear surface view of FIG. 29(*a*)
Figure 29:
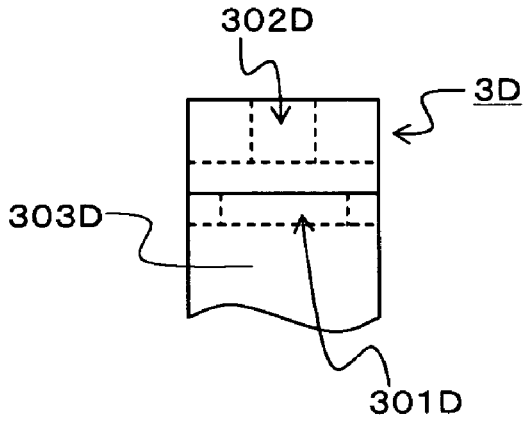
Figure 29:
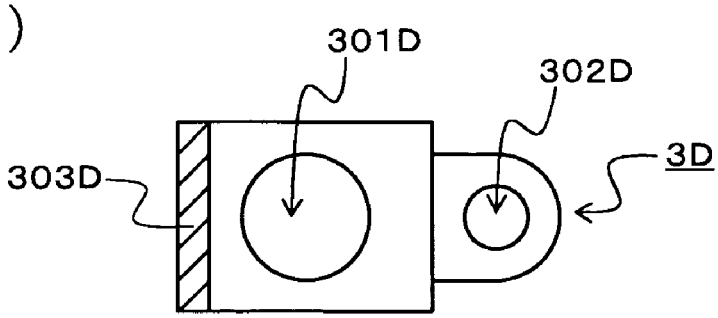
Figure 30:
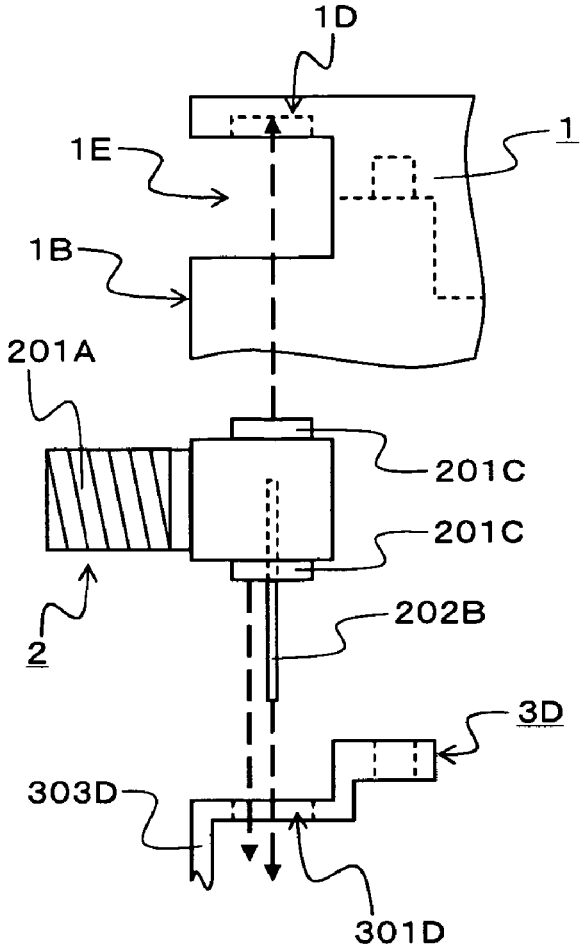
FIG. 30 is a schematic illustration showing a schematic structure of the coaxial cable distributor of the present fourth embodiment, and FIGS. 30(*a*) and 30(*b*) are views for explaining a fitting method of the junction plug.
Figure 30:
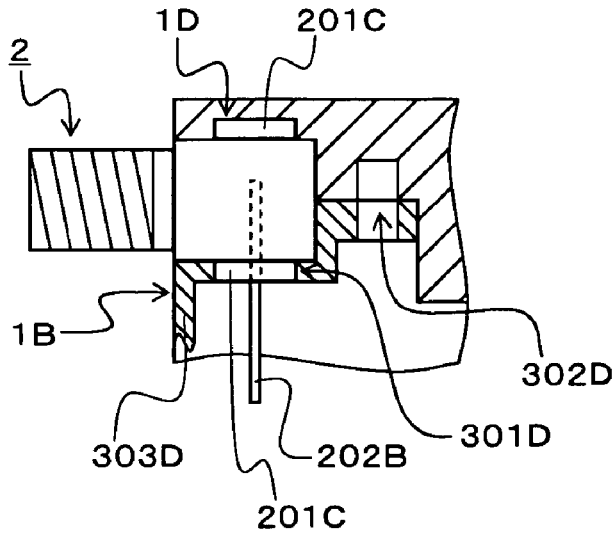

FIGS. 26 to 31 are schematic illustrations showing a schematic structure of a coaxial cable distributor of a fourth embodiment according to the present invention. FIG. 26(*a*) is a top view of the distributor, and FIG. 26(*b*) is a front view of FIG. 26(*a*), and FIG. 26(*c*) is a right side view of FIG. 26(*b*). FIG. 27 is a view showing the internal structure of the distributor. FIG. 28(*a*) is a fragmentary front view of a junction plug fitting of a casing, and FIG. 28(*b*) is a left side view of FIG. 28(*a*), and FIG. 28(*c*) is a bottom view seen from the line C to C' of FIG. 28(*a*). FIG. 29(*a*) is a fragmentary front view of a junction plug fixing bracket, and FIG. 29(*b*) is a left side view of FIG. 29(*a*), and FIG. 29(*c*) is a rear surface view of FIG. 29(*a*). FIGS. 30(*a*) and 30(*b*), and FIGS. 31(*a*) and 31(*b*) are views for explaining a fitting method of the junction plug.

The coaxial cable distributor of the present fourth embodiment, as shown in FIGS. 26(*a*), 26(*b*), and 26(*c*), is fitted with five terminals (hereinafter referred to as junction plug) 2 for connecting a coaxial cable on the surface of a metal casing 1. Further, three from among the junction plugs 2 are fitted on a first surface 1A of the casing 1, and the remaining two junction plugs are fitted on a second surface 1B and a fourth surface 11 contacting the first surface 1A for one each, respectively. Since the five junction plugs 2 have the same structure as the junction plugs 2 described in the first embodiment, the detailed description thereof will be omitted.

Further, the casing 1 has a hollow therein, and the external contacts 201 of each junction plug 2, as shown in FIG. 27, are electrically connected to each other by the casing 1. At this time, since the connecting method of the external contacts 201 of the junction plug 2 fitted to the first surface 1A and the casing 1 is, for example, the same as that by the junction plug fixing bracket 3 (3C) described in the third embodiment, the detailed description thereof will be omitted.

Within the casing 1 of the coaxial cable distributor of the present fourth embodiment, a portion in which the junction plug 2 of the second surface 1B is fitted, as shown in FIGS. 28(*a*), 28(*b*), and 28(*c*), is provided with a bottom corresponding to a projection 201C of the external contact of the junction plug 2, that is, a bearing 1D having a circular bottom. Further, a portion fitted with the junction plug 2 is provided with a window 1E opened in three directions. Further, the second surface 1B, as shown in FIG. 28(*b*), is provided with an opening 1J to make it easy to fit the junction plug 2.

Further, the junction plug fixing bracket 3 (3D) for fixing the junction plug 2 to be fitted to the second surface 1B of the casing 1, as shown in FIGS. 29(*a*), 29(*b*), and 29(*c*), is provided with a circular bearing 301D and a screw hole 302D to be fitted to the casing 1. Further, one end of the junction plug fixing bracket 3D is provided with a plate 303D for blocking the opening 1J of the casing 1.

Figure 31:
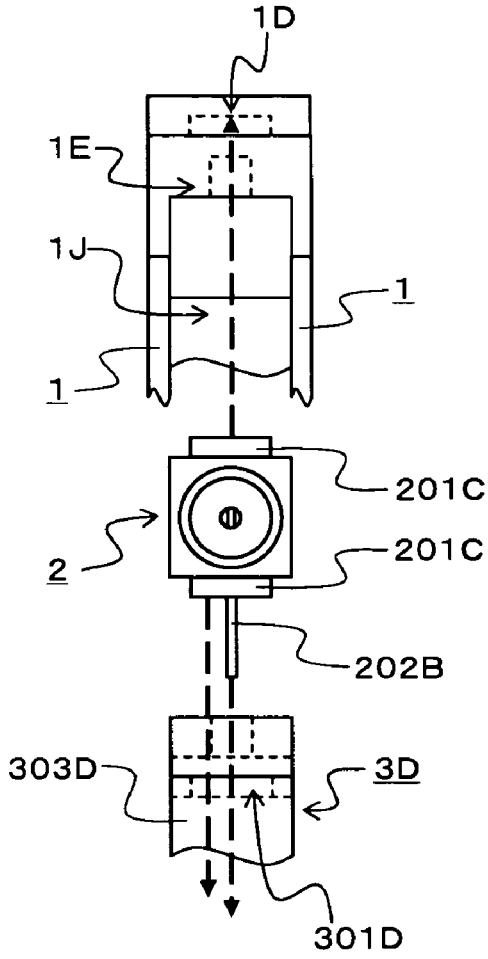
FIG. 31 is a schematic illustration showing a schematic structure of the coaxial cable distributor of the present fourth embodiment, and FIGS. 31(*a*) and 31 (*b*) are views for explaining a fitting method of the junction plug.
Figure 31:
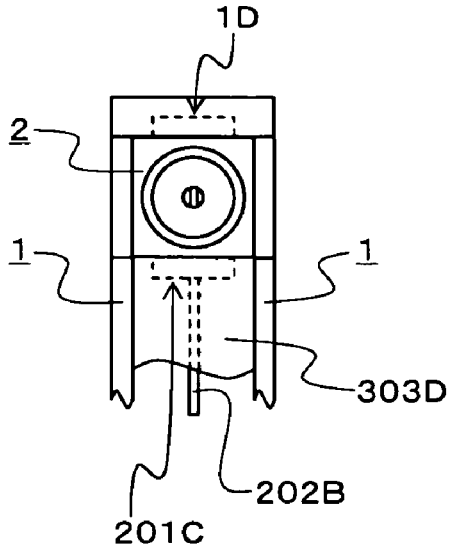

To fit the junction plug 2 on the second surface 1B of the casing 1 by using the junction plug fixing bracket 3 (3D), as shown in FIGS. 30(*a*) and 30(*b*), and FIGS. 31(*a*) and 31(*b*), from among the projections 201C provided in the external contact of the junction plug 2, the projection from those in which the contact pin 202B is not led out is borne by the bearing 1D provided in the casing 1. Further, the projection 201C provided with the contact pin 202B is borne by the bearing 301D of the junction plug fixing bracket 3 (3D). At this time, if the bearing 301D of the junction plug fixing bracket 3 (3D) is allowed to be penetrated, the contact pin 202B and the junction plug fixing bracket 3 (3D) will not be brought into contact. In this state, if the junction plug fixing bracket 3 (3D) is fixed to the casing 1 by using the screw hole 302D, the junction plug 2 can be rotated with the projection 201C provided in the external contact as an axis of rotation. At this time, as shown in FIG. 30(*a*), if the window 1E of the casing 1 is provided so as to be opened in three directions, the junction plug 2 can be rotated 180 degree. Further, at this time, by providing the opening 1J in the casing 1, it becomes easy to fit the junction plug 2, but if the plug 2 is kept as it is, an electrical field (magnetic field) leaks from the opening 1J. Hence, as shown in FIGS. 29(*a*), 29(*b*), and 29(*c*), the junction plug fixing bracket 3D is provided with the plate 303D, and by blocking the opening 1J of the casing 1 by this plate 303D, the leakage of the electrical field (magnetic field) can be prevented.

Further, when the junction plug 2 is fitted to a fourth surface 1I of the casing 1, since the fitting method may be the same as when it is fitted to the second surface 1B, the detailed description thereof will be omitted.

Further, the casing 1, as shown in FIG. 27, has an hollow provided therein, and the hollow is provided with a printed circuit board for electrically connecting the center contacts (contact pins) of each junction plug to each other. At this time, the casing 1 is opened in one surface direction, and from this opening, the printed circuit board 4 is inserted, and the conductor patterns of the contact pin 202B and the printed circuited board 4 are soldered, and after that, the opened surface is fitted with a back cover 5.

Figure 32:
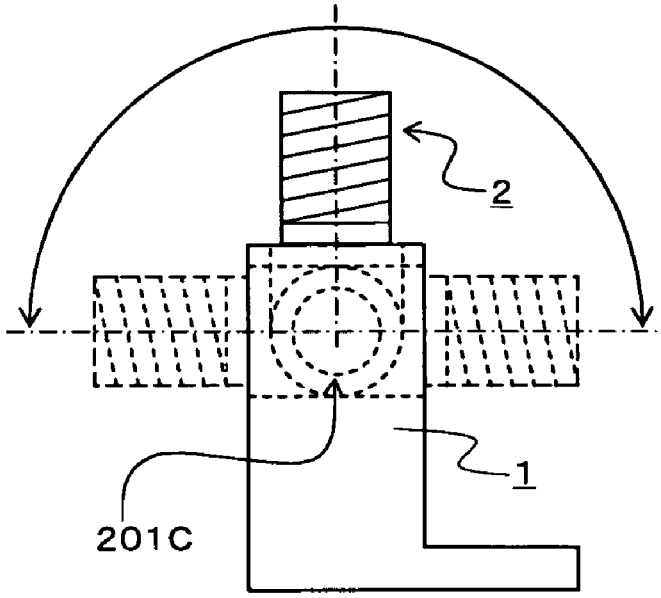
FIG. 32 is a schematic illustration for explaining an operation effect of the coaxial cable distributor of the present fourth embodiment, and FIG. 32(*a*) is a schematic illustration explaining the operation of the junction plug fitted to a first surface of the casing, and FIG. 32(*b*) is a view for explaining the operation of the junction plug fitted to a second surface of the casing.
Figure 32:
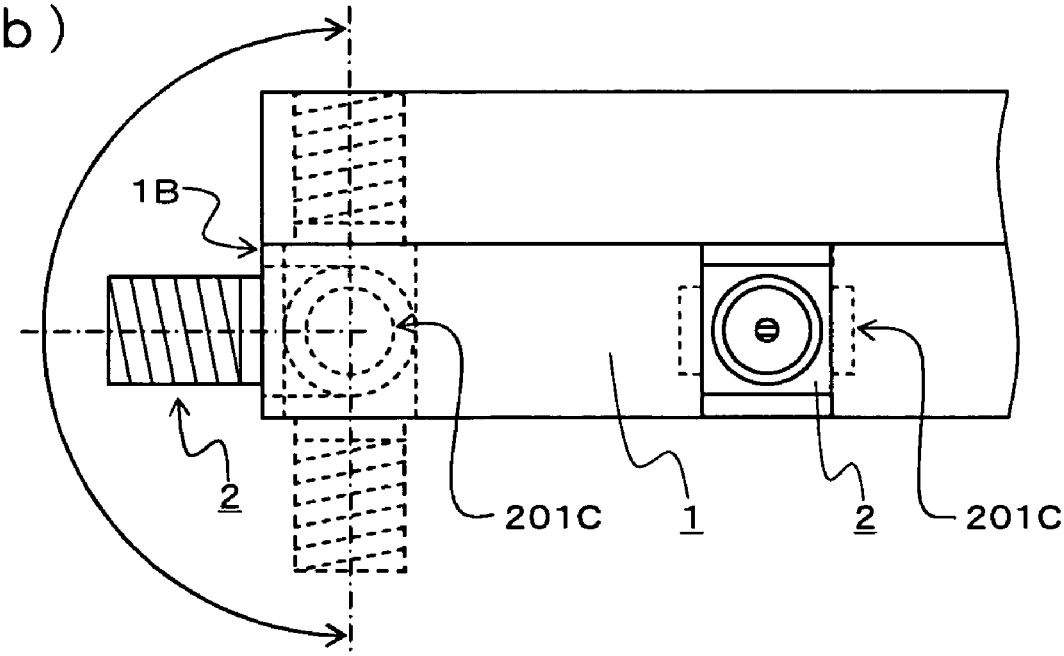

FIG. 32 is a schematic illustration for explaining the operation effect of the coaxial cable distributor of the present fourth embodiment. FIG. 32(*a*) is a schematic illustration for explaining the operation of the junction plug fitted to the first surface of the casing, and FIG. 32(*b*) is a view for explaining the operation of the junction plug fitted to the second surface of the casing.

From among the coaxial cable distributors of the present fourth embodiment, the junction plug 2 fitted to the first surface 1A of the casing 1 is, for example, the same as the junction plug 2 described in the third embodiment, and as shown in FIG. 32(*a*), can be rotated 180 degree with the projection 201C as a point of support. Further, the junction plugs 2 fitted to the second surface 1B and the third surface 1I can be also, as shown in FIG. 32(*b*), rotated 180 with the projection 201C as a point of support. Hence, a degree of freedom of the leading direction of the coaxial cable connected to each junction plug 2 is enhanced. Further, operability is good at the time of connecting the coaxial cable to each junction plug 2.

As described above, according to the coaxial cable distributor of the present fourth embodiment, since the junction plug 2 fitted to the casing 1 can be rotated, a degree of freedom of the leading direction of the coaxial cable is enhanced. Hence, comparing to the conventional distributor, its versatility is enhanced.

Further, since the junction plug 2 can be rotated, in case a distance between the surface fitted with the distributor such as a wall surface and the like and the junction plug 2 is short, and even in case plural junction plugs are lined up and the interval between the junction plugs is narrow, operability is good at the time of connecting the coaxial cable to the junction plug 2.

Further, since the junction plug 2 is rotated, the bending of the coaxial cable connected to the junction plug 2 can be kept to a minimum. Hence, generation of noises and breaking of the cable due to the bending of the coaxial cable can be prevented.

Fifth Embodiment

Figure 33:
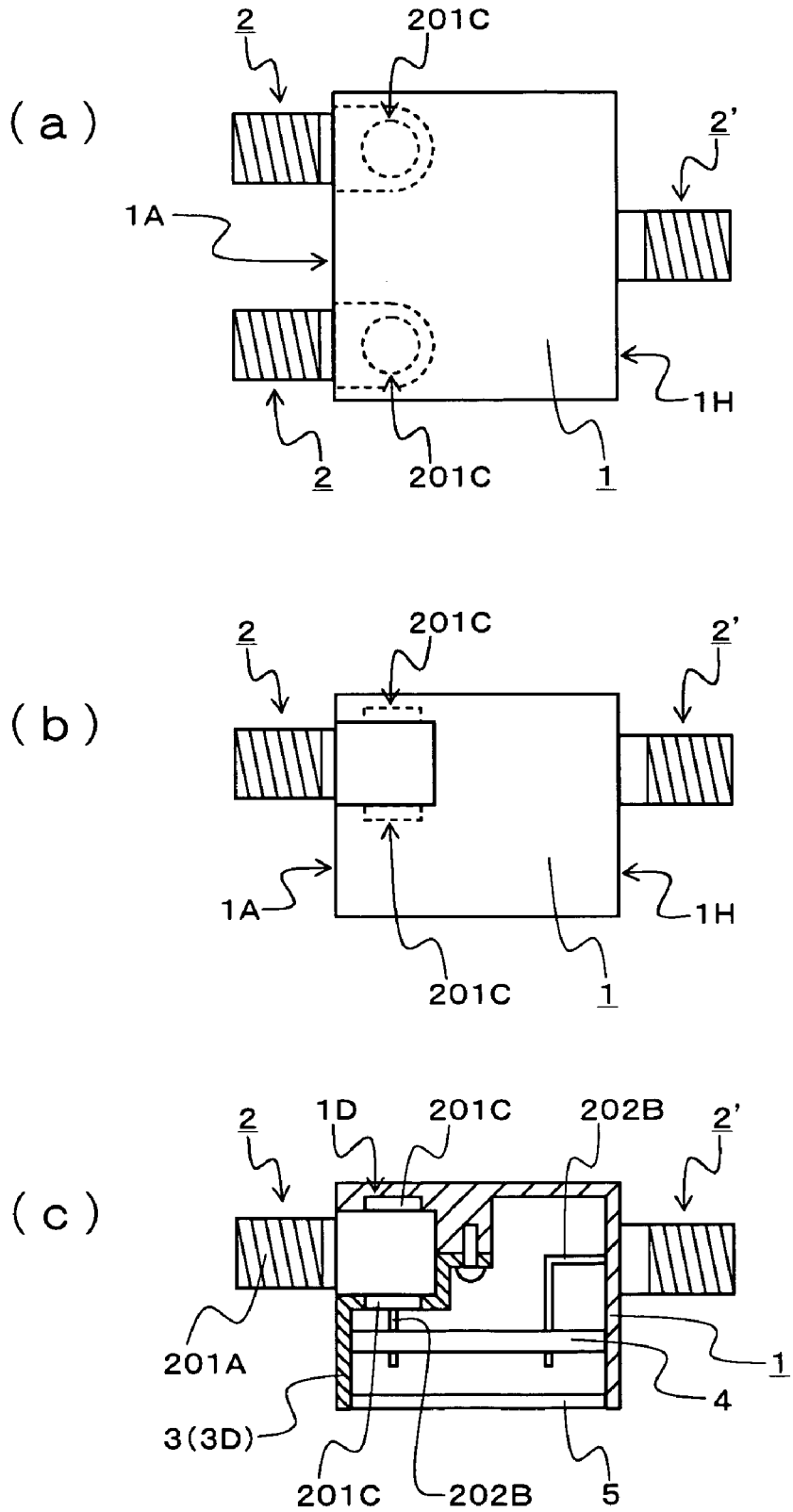
FIG. 33 is a schematic illustration showing a schematic structure of the coaxial cable distributor of a fifth embodiment according to the present invention, and FIG. 33(*a*) is a top plan view of the distributor, and FIG. 33(*b*) is a front view of FIG. 33(*a*), and FIG. 33(*c*) is a view showing the internal structure of the distributor.
Figure 34:
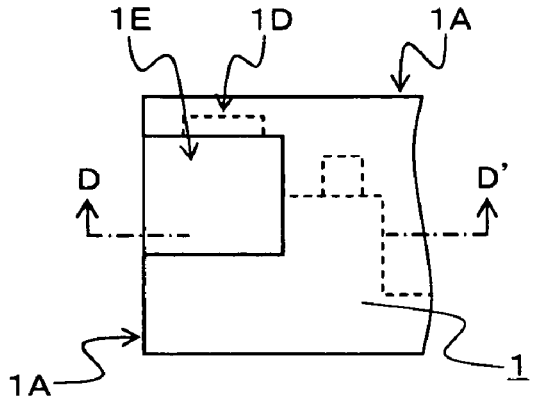
FIG. 34 is a schematic illustration showing a schematic structure of the coaxial cable distributor of the present fifth embodiment, and FIG. 34(*a*) is a fragmentary front view of the junction plug fitting of the casing, and FIG. 34(*b*) is a left side view of FIG. 34(*a*), and FIG. 34(*c*) is a bottom view seen from the line D to D' of FIG. 34(*a*)
Figure 34:
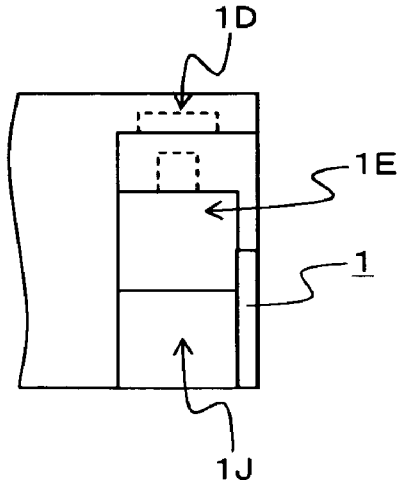
Figure 34:
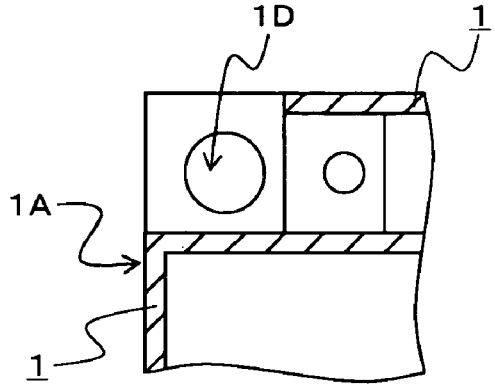
Figure 35:
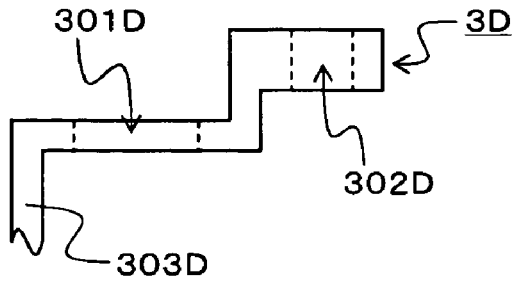
FIG. 35 is a schematic illustration showing a schematic structure of the coaxial cable distributor of the present fifth embodiment, and FIG. 35(*a*) is a fragmentary front view of the junction plug of the casing, and FIG. 35(*b*) is a left side view of FIG. 35(*a*), and FIG. 35(*c*) is a rear surface view of FIG. 35(*a*)
Figure 35:
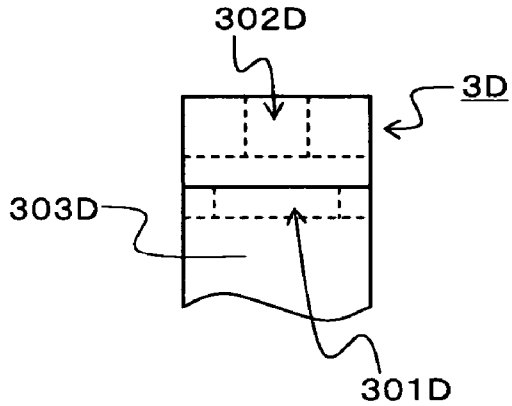
Figure 35:
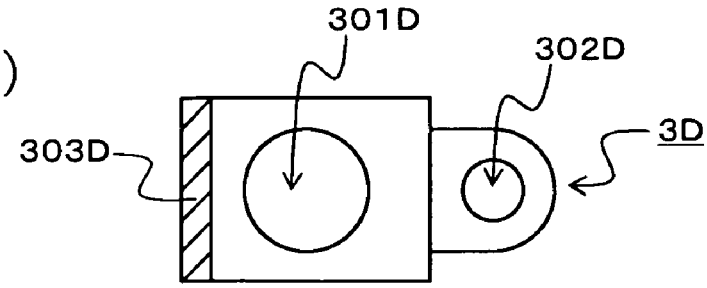
Figure 36:
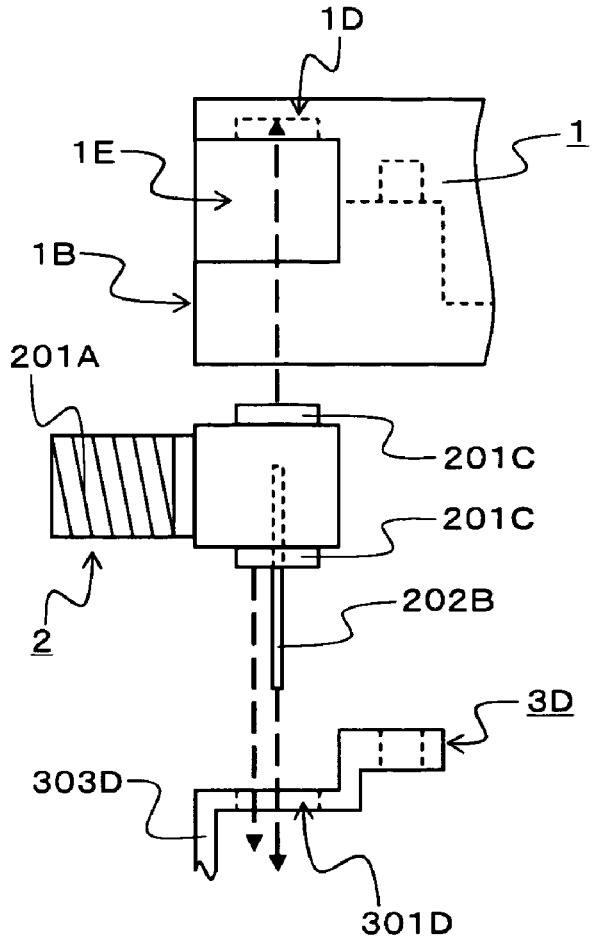
FIG. 36 is a schematic illustration showing a schematic structure of the coaxial cable distributor of the present fifth embodiment, and FIGS. 36(*a*) and 36(*b*) are views for explaining the fitting method of the junction plug.
Figure 36:
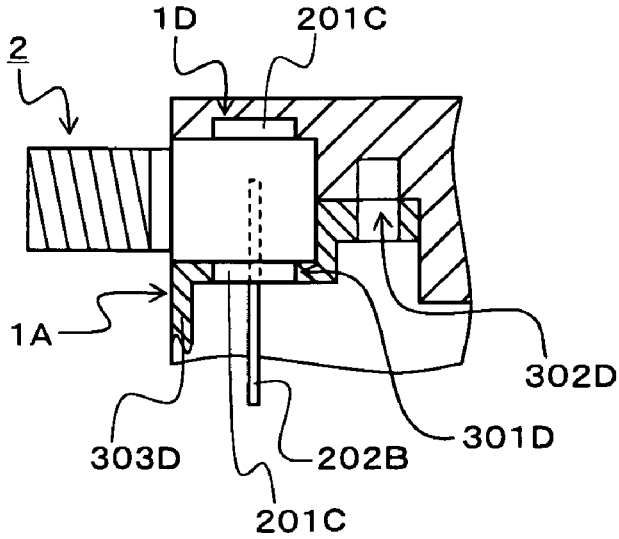

FIGS. 33 to 37 are schematic illustrations showing a schematic structure of a coaxial cable distributor of a fifth embodiment according to the present invention. FIG. 33(*a*) is a top view of the distributor, and FIG. 33(*b*) is a front view of FIG. 33(*a*), and FIG. 33(*c*) is a view showing the internal structure of the distributor. FIG. 34(*a*) is a fragmentary front view of a junction plug fitting of a casing, and FIG. 34 (*b*) is a left side view of FIG. 34(*a*), and FIG. 34(*c*) is a bottom view seen from the line D to D' of FIG. 34(*a*). FIG. 35(*a*) is a fragmentary front view of a junction plug fixing bracket, and FIG. 35(*b*) is a left side view of FIG. 35(*a*), and FIG. 35 (*c*) is a rear surface view of FIG. 35(*a*). FIGS. 36(*a*) and 36(*b*), and FIGS. 37(*a*) and 37(*b*) are views for explaining a fitting method of the junction plug.

The coaxial cable distributor of the present fifth embodiment, as shown in FIGS. 33(*a*) and 33(*b*), is fitted with three terminals (hereinafter referred to as junction plug) 2 for connecting a coaxial cable on the surface of a metal casing 1. At this time, two junction plugs are fitted to a first surface 1A of the casing 1, and the remaining one junction plug is fitted to a rear surface 1H of the first surface 1A. Further, since the two junction plugs 2 fitted to the first surface 1A are of the same structure as the junction plugs described in the first embodiment, the detailed description thereof will be omitted. Further, since a junction plug 2' fitted to the rear surface 1H of the first surface is fitted to the casing by the same method as the conventional junction plug, the detailed description thereof will be omitted.

Further, the casing 1 has a hollow therein, and the external contacts 201 of each junction plug 2, as shown in FIG. 33(*c*), are electrically connected to each other by the casing 1.

Within the casing 1 of the coaxial cable distributor of the present fifth embodiment, a portion to which the junction plug 2 of the first surface 1A is fitted, as shown in FIGS. 34 (*a*), 34(*b*), and 34(*c*), is provided with a bottom corresponding to a projection 201C of the external contact of the junction plug 2, that is, a bearing 1D having a circular bottom. Further, a portion fitted with the junction plug 2 is provided with a window 1E opened in three directions. Further, the first surface 1A, as shown in FIG. 34(*b*), is provided with an opening 1J to make it easy to fit the junction plug 2.

Further, the junction plug fixing bracket 3 (3D) for fixing the junction plug 2 to be fitted to the first surface 1A of the casing 1, as shown in FIGS. 35(*a*), 35(*b*), and 35(*c*), is provided with a circular bearing 301D and a screw hole 302D for fitting the junction plug 2 to the casing 1. Further, one end of the junction plug fixing bracket 3D is provided with a plate 303D for blocking the opening 1J of the casing 1.

Figure 37:
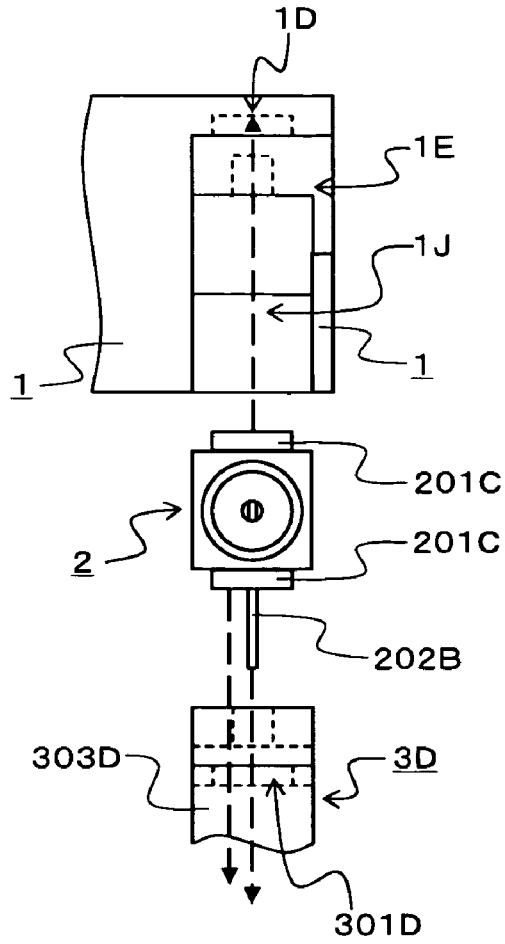
FIG. 37 is a schematic illustration showing a schematic structure of the coaxial cable distributor of the present fifth embodiment, and FIGS. 37(*a*) and 37(*b*) are views for explaining the fitting method of the junction plug.
Figure 37:
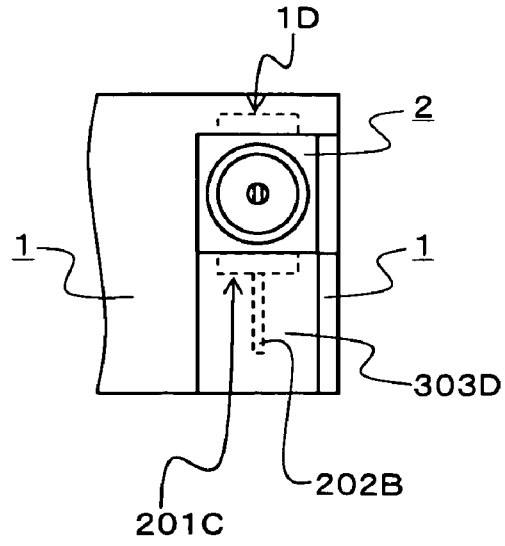

To fit the junction plug 2 on the second surface 1B of the casing 1 by using the junction plug fixing bracket 3 (3D), as shown in FIGS. 36(*a*) and 36(*b*), and FIGS. 37(*a*) and 37(*b*), from among the projections 201C provided in the external contact of junction plug 2, the projection from those in which the contact pin 202B is not led out is borne by the bearing 1D provided in the casing 1. Further, the projection 201C provided with the contact pin 202B is borne by the bearing 301D of the junction plug fixing bracket 3 (3D). At this time, if the bearing 301D of the junction plug fixing bracket is allowed to be penetrated, the contact pin 202B and the junction plug fixing bracket 3 (3D) will not be brought into contact. In this state, if the junction plug fixing bracket 3 (3D) is fixed to the casing 1 by using the screw hole 302D, the junction plug 2 can be rotated with the projection 201C provided in the external contact as an axis of rotation. At this time, as shown in FIG. 36(*a*), if the window 1E of the casing 1 is provided so as to be opened in two directions, the junction plug 2 can be rotated 90 degree. Further, at this time, by providing the opening 1J in the casing 1, it becomes easy to fit the junction plug 2, but if the plug 2 is kept as it is, an electrical field (magnetic field) leaks from the opening 1J. Hence, as shown in FIGS. 35(*a*), 35(*b*), and 35(*c*), the junction plug fixing bracket 3D is provided with the plate 303D, and by blocking the opening 1J of the casing 1 by this plate 303D, the leakage of the electrical field (magnetic field) can be prevented.

Further, the casing 1, as shown in FIG. 33(*c*), has a hollow provided therein, and the hollow is provided with a printed circuit board 4 for electrically connecting the center contacts (contact pins) of each junction plug to each other. At this time, the casing 1 is opened in one surface direction, and from this opening, the printed circuit board 4 is inserted, and the conductor patterns of the contact pin 202B and the printed circuited board 4 are soldered, and after that, the opened surface is fitted with a back cover 5.

Figure 38:
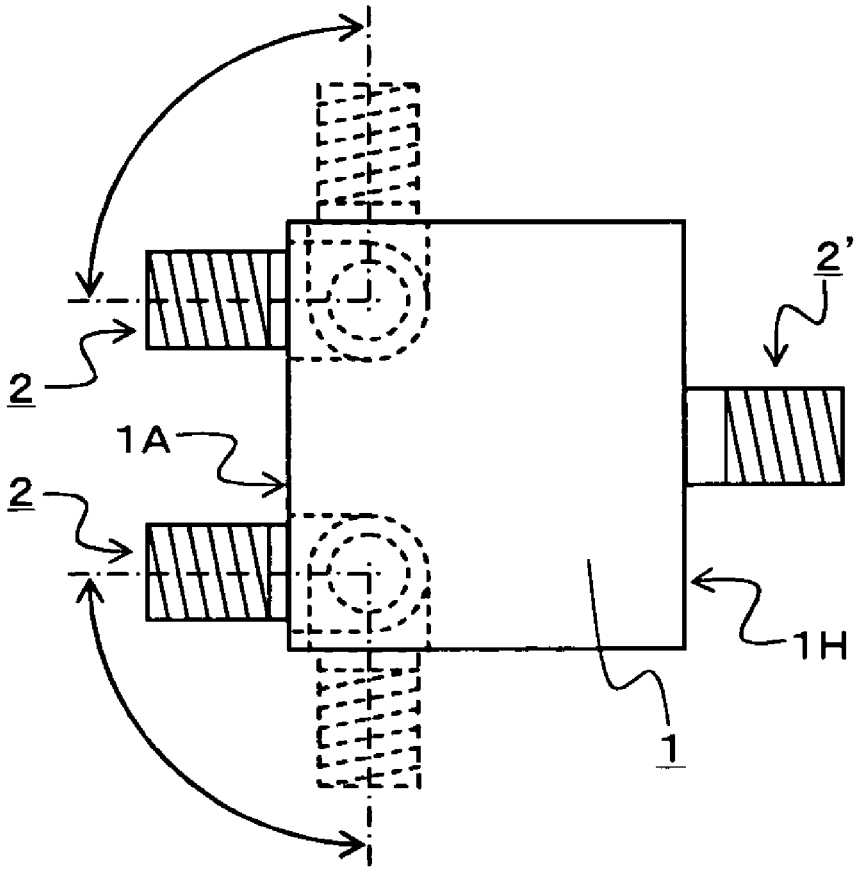
FIG. 38 is a schematic illustration explaining the operation effect of the coaxial cable distributor of the present fifth embodiment.

FIG. 38 is a schematic illustration for explaining the operation effect of the coaxial cable distributor of the present fifth embodiment.

The coaxial cable distributor of the present fifth embodiment, as shown in FIG. 38, can rotate the junction plugs 2 fitted to the first surface 1A of the casing 1 90 degree, respectively. Hence, the coaxial cables connected to the two junction plugs 2 can be led out in parallel or led out to be orthogonal to each other or led out in a direction reverse to each other. Further, since the rotating junction plug 2 can be rotated while maintaining electrical connection, it can be rotated at a loose angle not only parallel with or vertical to a projecting direction of the junction plug 2 fitted to the first surface 1A, but also within 0 to 90 degree.

Further, in case the coaxial cables connected to each junction plug 2 provided on the first surface 1A of the casing 1 are led out in parallel, when the junction plugs 2 are fixed as conventionally, and the interval between each junction plug 2 is narrow, operability is poor at the time of connecting the coaxial cables. In the mean time, in the case of the coaxial cable distributor of the present fifth embodiment, only when the coaxial cable is connected, the direction of the junction plug 2 can be changed, and therefore, operability is good at the time of connecting the coaxial cable.

As described above, according to the coaxial cable distributor of the present fifth embodiment, since the junction plug 2 fitted to the casing 1 can be rotated, a degree of freedom of the leading direction of the coaxial cable is enhanced. Hence, comparing to the conventional distributor, its versatility is enhanced.

Further, since the junction plug 2 can be rotated, in case a distance between the surface fitted with the distributor such as a wall surface and the like and the junction plug 2 is short, and even in case the interval between the junction plugs is narrow, operability is good at the time of connecting the coaxial cable to the junction plug 2.

Further, since the junction plug 2 is rotated, the bending of the coaxial cable connected to the junction plug 2 can be kept to a minimum. Hence, generation of noises and breaking of the cable due to the bending of the coaxial cable can be prevented.

As described above, while the present invention has been specifically described based on the above described embodiments, the invention is not limited to those embodiments, and it goes without saying that various modifications are possible within the scope without departing from the spirit of the invention.

For example, in each of the above described embodiments, while a description has been made with the coaxial cable distributor cited as an example, the invention is not limited to this, and the turnout having the same structure as the distributor may be adapted to the present invention. In the case of the turnout also, as the junction plug to be fitted, if the junction plug described in the first embodiment is used, and the projection of the external contact is borne by the bearing of the casing and the bearing of the junction plug fixing bracket, the junction plug of the turnout can be also rotated, thereby acquiring the same effect as the distributor.

INDUSTRIAL APPLICABILITY

As described above, the coaxial cable distributor according to the present invention is high in the degree of freedom of the leading direction of a connected cable, and operability is also good, so that the extreme bending of the coaxial cable can be also prevented. Hence, it is usable at the place where the space is narrow and many coaxial cables must be connected.

The invention claimed is:

1. A coaxial cable distributor, configured to be fitted with three or more coaxial cable connecting terminals referred to as junction plugs, comprising a center contact and a cylindrical external contact concentrically provided with said center contact on the surface of an electroconductive casing having a hollow therein, wherein said external contacts of each junction plug are electrically connected to each other by said casing, and wherein, from among said junction plugs, at least two junction plugs are rotated with a direction orthogonal to a projecting direction from said casing surface as an axis of rotation, while maintaining mutual electrical contacts between said external contacts and said center contacts, and wherein the coaxial structure of said center contact and said external contact of each rotating junction plug and the coaxial structure about the connection between said external contact and said casing are maintained before and after the rotation of said rotating junction plugs.

2. The coaxial cable distributor according to claim 1, wherein the external contact of said rotating junction plug is configured by joint for connecting the outer conductor of said coaxial cable or the outer conductor of the plug provided on the top end of said coaxial cable, and a hinged end in which an opening to lead out a projection having a circular bottom and said center contact outside of said external contact is provided, and wherein said casing is provided with a support for supporting said projection provided in the hinged end of said external contact.

* * * * *